US005451043A

United States Patent [19]

Arai

[11] Patent Number: 5,451,043

[45] Date of Patent: Sep. 19, 1995

[54] SHEET FEEDING MECHANISM FOR FEEDING SHEETS AND SHEET GUIDING EQUIPMENT FOR CONVEYING SHEETS

[75] Inventor: Kiyotaka Arai, Osaka, Japan

[73] Assignee: Mita Industrial Co., Ltd., Osaka, Japan

[21] Appl. No.: 914,560

[22] Filed: Jun. 2, 1992

[30] Foreign Application Priority Data

| | | | |
|---|---|---|---|
| Jul. 24, 1991 | [JP] | Japan | 3-184549 |
| Jul. 24, 1991 | [JP] | Japan | 3-184550 |
| Jul. 24, 1991 | [JP] | Japan | 3-184551 |
| Jul. 24, 1991 | [JP] | Japan | 3-184552 |
| Aug. 23, 1991 | [JP] | Japan | 3-212109 |

[51] Int. Cl.[6] ..... B65H 3/52

[52] U.S. Cl. ..... 271/122; 271/146; 271/164; 271/121; 271/167

[58] Field of Search ..... 271/121, 122, 146, 162, 271/164, 171, 167, 124, 125

[56] References Cited

U.S. PATENT DOCUMENTS

| | | | |
|---|---|---|---|
| 4,516,764 | 5/1985 | Tamura | 271/162 X |
| 4,548,394 | 10/1985 | Koyama et al. | 271/9 |
| 4,572,498 | 2/1986 | Shiozawa | 271/167 X |

FOREIGN PATENT DOCUMENTS

| | | | |
|---|---|---|---|
| 0281073 | 9/1988 | European Pat. Off. . | |
| 32212261 | 1/1983 | Germany . | |
| 0270737 | 11/1990 | Japan | 271/162 |

OTHER PUBLICATIONS

*Patent Abstracts of Japan,* vol. 005, No. 115 (P-072) 24 Jul. 1981 & JP-A-56 057 077 (Canon, Inc.) 19 May 1981.

*Patent Abstracts of Japan,* vol. 010, No. 267 (M-516) 11 Sep. 1986 and JP-A-61 090 943 (Olympus Optical Co. Ltd.) 9 May 1986.

*Patent Abstracts of Japan,* vol. 9, No. 245 (M-418) (1968) 2 Oct. 1985 & JP-A-60 97 142 (Fuji Xerox) 30 May 1985.

*Patent Abstracts of Japan,* vol. 012, No. 432 (M-763) 15 Nov. 1988 & JP-A-63 165 228 (Toshiba Corp.) 8 Jul. 1988.

*Patent Abstracts of Japan,* vol. 11, No. 131 (M-584)(2578) 24 Apr. 1987 & JP-A-61 273 444 (Hitachi Koki Co., Ltd.) 3 Dec. 1986.

*Patent Abstracts of Japan,* vol. 12, No. 10 (M-658)(2857) 13 Jan. 1988 & JP-A-62 17 847 (Konishiroku Photo Ind. Co., Ltd.) 28 Jul. 1987.

*Patent Abstracts of Japan,* vol. 9, No. 279 (M-427)(2002) 7 Nov. 1985 & JP-A-60 122 643 (Canon K.K.) 1 Jul. 1985.

*Patent Abstracts of Japan,* vol. 009, No. 174 (P-374) 19 Jul. 1985 & JP-A-60 049 350 (Fuji Xerox KK) 18 Mar. 1985.

*Patent Abstracts of Japan,* vol. 006, No. 210 (M-166) 22 Oct. 1982 and JP-A-57 117 437 (Tokyo Shibaura Denki) 21 Jul. 1982.

*Patent Abstracts of Japan,* vol. 007, No. 116 (M-216) 20 May 1983 & JP-A-58 036 841 (Konishiroku Shashin Kogyo) 3 Mar. 1983.

*Patent Abstracts of Japan,* vol. 8, No. 40 (M-278) (1477) 21 Feb. 1984 & JP-A-58 197 142 (Fuji Xerox) 16 Nov. 1983.

*Patent Abstracts of Japan,* vol. 011, No. 025 (M-556) 23 Jan. 1987 & JP-A-61 197 338 (Hitachi Ltd.) 1 Sep. 1986.

*Patent Abstracts of Japan,* vol. 006, No. 038 (P-105) 9 Mar. 1982 & JP-A-56 154 758 (Konishiroku Photo Ind. Co., Ltd.) 30 Nov. 1981.

*Primary Examiner*—H. Grant Skaggs
*Assistant Examiner*—Carol Lynn Druzbick
*Attorney, Agent, or Firm*—Beveridge, DeGrandi, Weilacher & Young

[57] ABSTRACT

A sheet feeding mechanism for feeding sheets is described including an advance preventive member which is abuttable on the sheet feeding roller by a spring. The advance preventive member functions to prevent multiple feeding of sheets. The sheet feeding cassette has a first sheet advance preventive part which acts on a second sheet advance preventive part on the advance preventive member when the sheet feeding cassette is moved toward or away from the sheet feeding roller, to thereby separate the advance preventive member from the sheet feeding roller against the urging force of a spring. Specific designs of the first and second sheet advance preventive parts may be included to vibrate and rotate a roller of the advance preventive member.

17 Claims, 16 Drawing Sheets

SHEET FEEDING MECHANISM FOR FEEDING SHEETS AND SHEET GUIDING EQUIPMENT FOR CONVEYING SHEETS

BACKGROUND OF THE INVENTION

1. Field of the Invention

The present invention relates to a mechanism for feeding sheets and sheet guiding equipment for conveying sheets in, for example, an image forming apparatus.

2. Related Art of the Invention

Heretofore, as shown in FIG. 1, an image forming apparatus is provided with a sheet feeding cassette 500 for storing sheets, a pick up roller 220 for feeding the sheet from the sheet feeding cassette 500, and a guide plate 230 for guiding the sheet having been fed by the pick up roller 220. On the upper central side of the guide plate 230, a sheet feeding roller 100 is provided; on the lower central side of the guide plate 230, a pad mounting plate 130 is provided; and a friction pad roller 800 mounted to the pad mounting plate 130 is urged by a spring 200 being urging means so as to abut on the sheet feeding roller 100.

Further downstream from the guide plate 230 are provided a pair of conveying rollers 240 and a pair of resist rollers 250 to feed the sheet to a photo-sensitive drum 210.

When the pick up roller 220 feeds a sheet from the sheet feeding cassette 500 toward the sheet feeding roller 100, the friction pad roller 800 abutting on the sheet feeding roller 100 moves downward by a thickness of the sheet against an urging force of the spring 200. The sheet is held between the sheet feeding roller 100 and the friction pad roller 800, and the sheet feeding roller 100 rotates in the arrow direction, thereby conveying the sheet to the downstream side. At this point, when the pick up roller 220 feeds a plurality of sheets toward the sheet feeding roller 100, though those sheets are held between the sheet feeding roller 100 and the friction pad roller 800, only the upper-most sheet is conveyed to the downstream side, so that the friction pad roller 800 prevents the multiple-feeding of the lower sheets by the friction force thereof.

However, in such a sheet feeding mechanism, when a plurality of sheets are fed as described above, the remaining sheets not conveyed are left held between the sheet feeding roller 100 and the friction pad roller 800. At this point, when there are no sheets in the sheet feeding cassette 500, the attempt to draw the sheets in order to supply sheets causes one end of the sheets to become in a fixed condition, thereby developing a first problem that the sheets are wrinkled or torn.

Further the friction pad roller 800 in such sheet feeding mechanism cannot prevent the multiple feeding if the part thereof abutting on the sheet feeding roller 100 moves in the sheet feeding direction, so that the friction pad roller 800 must be fixed to a bracket 130 so as not to be rotated, or should have a special mechanism for preventing the multiple feeding where it can be rotated, or operated in a manner to be rotated and fixed each time it feeds the sheet.

Thus, a second problem develops that where the friction pad roller 800 is fixed to the bracket 130, the part abutting on the sheet feeding roller 100 wears rapidly and the friction pad roller 800 becomes short in life, while where it can be rotated, the equipment becomes complex or its operation becomes complicated.

Further in the method of mounting the friction pad roller 800 in the sheet feeding mechanism as arranged above, when the friction pad roller 800 wears at the surface thereof and is replaced, it is necessary to remove the spring 200, replace the friction pad roller 800, and then remount the spring 200.

Accordingly, before and after the replacement of the friction pad roller 800, a difference is likely to occur in the urging force of the spring 200, thereby developing a third problem that a change in the urging force causes sheet feeding trouble such as non-sheet feeding or multiple feeding.

On the other hand, a copying machine of the prior art having a sheet feeding mechanism by which a plurality of sheet feeding cassettes are generally provided with a first conveying passage for feeding a sheet from one sheet feeding cassette thereof and a second conveying passage for feeding a sheet from the other sheet feeding cassettes, and further a third conveying passage which extends from the point where the first and the second conveying passages join toward a pair of conveying rollers to convey the sheet conveyed from the first conveying passage and that from the second conveying passage to the pair of conveying rollers provided upstream.

Now, where a sheet of the sheet feeding cassette on the first conveying passage side is selected, the sheet is conveyed by a sheet feeding roller for that sheet feeding cassette through the first conveying passage to the third conveying passage and fed to the pair of conveying rollers, while where a sheet of the sheet feeding cassette on the second conveying passage is selected, the sheet is conveyed by a sheet feeding roller for that sheet feeding cassette through the second conveying passage to the third conveying passage and fed to the pair of conveying rollers.

However, in such sheet guiding equipment, depending on the conveying directions and the joining condition of the first, the second and the third conveying passages, when the the first conveyed a first sheet feeding roller through the first conveying passage to a third conveying passage, the sheet feeding direction may change at a sharp angle, or the leading edge of the sheet conveyed through the second conveying passage may hit an inner wall of the third conveying passage to force its direction to be changed, in which case a fourth problem develops that the sheet bends and jams in the third conveying passage without being fed smoothly to the pair of conveying rollers.

On the other hand, in a sheet feeding mechanism of the prior art, as shown in FIGS. 2(*a*) and 2(*b*), where the sheet feeding roller 100 of the copying machine is replaced due to wear and the like, in order to perform efficiently the replacement, a sheet feeding shaft 300 being a rotating shaft of the sheet feeding roller 100 is pivotably supported at the central part thereof by a vertically folded end 350 of a supporting member 340, and at the right end thereof on the drawing by a body frame 390. The left end of the sheet feeding shaft 300 is free, from which the sheet feeding roller 100 is easily detachable. In order that the sheet feeding roller 100 is smoothly rotated to allow sheet feeding to be certainly performed, the supporting member 340 is joined at the end 360 vertically folded on the body frame side 390 to the body frame side 390, and at a central plate 330 to a guide plate 320. The guide plate 320 is omitted in FIG. 2(*b*).

Then where a sheet 310 is fed from a sheet feeding cassette 370 having a separating jaw 380 as shown in FIG. 2(*a*), a load applied to the sheet feeding roller 100 is small at the time of sheet feeding, whereby an effect on the guide plate 320 and the like is almost out of the question even with the supporting method as described above.

However, with the method of feeding sheets utilizing a friction pad, the load at the time of sheet feeding becomes large, whereby an abnormal sound becomes liable to occur by the sheet feeding roller 100 and the friction pad, or by the vibration of the guide plate 320 in itself. And although the abnormal sound occurring between the sheet feeding roller 100 and the friction pad can be eliminated by considering the material and shape thereof, a fifth problem develops that the abnormal sound due to the vibration of the guide plate 320 in itself cannot be eliminated.

SUMMARY OF THE INVENTION

The present invention is made to solve the above first problem of the sheet feeding mechanism of prior art, and it is an object of the present invention to provide a sheet feeding mechanism with which sheets are not wrinkled or torn when a sheet feeding cassette thereof is pulled out.

That is, a sheet feeding mechanism of the present invention comprises:

a sheet feeding roller for feeding sheets, an advance preventive member which is abuttable on the sheet feeding roller by a use of urging means and is for preventing multiple feeding of sheets, and the advance preventive member having a first acted part, and while a sheet feeding cassette is being pulled out, a first acting part provided to the sheet feeding cassette acts on the first acted part of the advance preventive member, thereby the advance preventive member being separated from the sheet feeding roller against an urging force of the urging means.

In the present invention, where a plurality of sheets are fed to a sheet feeding roller and prevented from being multiply fed by an advance preventive member, and the sheet feeding cassette thereof is pulled out with the remaining sheets prevented from being multiply fed remaining held between the sheet feeding roller and the advance preventive member, a rail provided to the sheet feeding cassette abuts on a protrusion of the advance preventive member to allow the protrusion to be moved against the urging force of urging means, whereby an arm formed integrally with the protrusion is pivoted to allow a pad to be separated from the sheet feeding roller, and the sheets held between the sheet feeding roller and the pad to be released.

The present invention is also made to solve the above second problem of the sheet feeding mechanism of prior art, and it is an object of the present invention to provide a sheet feeding mechanism with which the life of the friction pad becomes longer, and the equipment is simple and requires no special operation.

That is, a sheet feeding mechanism of the present invention comprises:

a sheet feeding roller for feeding sheets, an advance preventive member which is abuttable on the sheet feeding roller by use of urging means and for preventing multiple feeding of sheets, a multiple feeding preventive roller of the advance preventive member being rotatable only in a direction reverse to sheet feeding direction, the advance preventive member having an acted part, and where a sheet feeding cassette is pulled out/set, an acting part provided to the sheet feeding cassette acts directly or indirectly on the acted part of the advance preventive member, thereby the multiple feeding preventive roller being separated from the sheet feeding roller against an urging force of the urging means.

In the present invention, when a sheet feeding cassette is pushed in/pulled out, an acting part provided to the sheet feeding cassette acts on an acted part of an advance preventive member to cause a multiple feeding preventive roller of the advance preventive member to be separated from a sheet feeding roller, and a vibration at the time of setting/pulling out of the sheet feeding cassette is transmitted to the multiple feeding preventive roller to allow the multiple feeding preventive roller becoming free from the sheet feeding roller to be rotated random in the direction reverse to the sheet feeding direction, thereby changing the abutting part of the multiple feeding preventive roller.

The present invention is also made to solve the above third problem of the multiple feeding preventive equipment of prior art, and it is an object of the present invention to provide multiple feeding preventive equipment with which before and after the replacement of a friction pad roller, the urging force of a spring does not change to allow a poor sheet feeding to occur.

That is, a sheet feeding mechanism of the present invention comprises:

a guide plate for guiding sheets, a side plate which has an opening and is connected downward to an end on a downstream side of the guide plate, a supporting member mounted to an underside of the guide plate, a pad supporting plate connected pivotably under the guide plate to the supporting member, pad means mounted removably to the guide plate side of the pad supporting plate for preventing multiple feeding, and urging means provided between the other part of the pad supporting plate and a part lower than the opening of the side plate in order to allow a pad of the pad means to abut on the sheet feeding roller by its urging force.

In the present invention, when pad means is replaced, utilizing an opening provided to a side plate, the pad means is removed from a pad supporting plate and new pad means is mounted to the pad supporting plate, and at this point, before and after the replacement of the pad means, urging means is not removed, so that the urging force thereof does not change.

The present invention is also made to solve the above fourth problem of the sheet guide equipment of prior art, and it is an object of the present invention to provide a sheet guide equipment which is simple in composition and inexpensive, and can convey sheets smoothly.

That is, a sheet guide equipment of the present invention comprises:

a first conveying passage, a second conveying passage, a third conveying passage formed as one passage by joining of the first conveying passage with the second conveying passage, and thin plate-like guide means which extends from a joining point of the first conveying passage with the second conveying passage in a conveying direction and which abuts on an inner wall of the third conveying passage, or a part of which is positioned near the inner wall, and the guide means being such that a part A having a specified length from a head is more bendable than the remaining part B.

In the present invention, with a sheet of a sheet feeding cassette fed to a first conveying passage, the sheet passing through the first conveying passage hits a hardly bendable part B of the guide means, changes certainly in the conveying direction, and is guided by the surface of the guide means and fed through a third conveying passage to a pair of conveying rollers. While when a sheet of another sheet feeding cassette is fed to a second conveying passage, the sheet passing through the second conveying passage is guided in a gap between the inner wall of the third conveying passage on which the head of the guide means abuts or near which part of the guide means is positioned an easily bendable part A of the guide means, and pushes down smoothly the head of the guide means, thereby being fed downstream.

The present invention is also made to solve the above fifth problem of the sheet feeding roller holding mechanism of the prior art, and it is an object of the present invention to provide a sheet feeding mechanism which inhibits a vibration of a guide plate in itself and eliminates an abnormal sound.

That is, a sheet feeding mechanism of the present invention comprises:

a sheet feeding roller for feeding sheets, a sheet feeding shaft at one end of which the sheet feeding roller is detachably mounted, a body frame for holding the other end of the sheet feeding shaft, a supporting member for supporting the sheet feeding shaft at the other end of the sheet feeding roller, a plate part mounted to the body frame for supporting the supporting member, and a vibration preventive member which is supported by the body frame and a part of which abuts on a specified position of the plate part, the supporting member or the sheet feeding shaft in a manner to prevent a deformation to which they are subjected.

In the present invention, a body frame supports a vibration preventive member, and part of the vibration preventive member abuts on a specified position of a plate, a supporting member, or a sheet feeding shaft in a manner to prevent a deformation to which they are subjected, whereby the vibration of the plate, the supporting member, or the sheet feeding shaft is prevented, to cause the abnormal sound to be eliminated.

PREFERRED EMBODIMENTS OF THE INVENTION

With reference to drawings, embodiments of the present invention will be described hereinafter.

Figure 1:
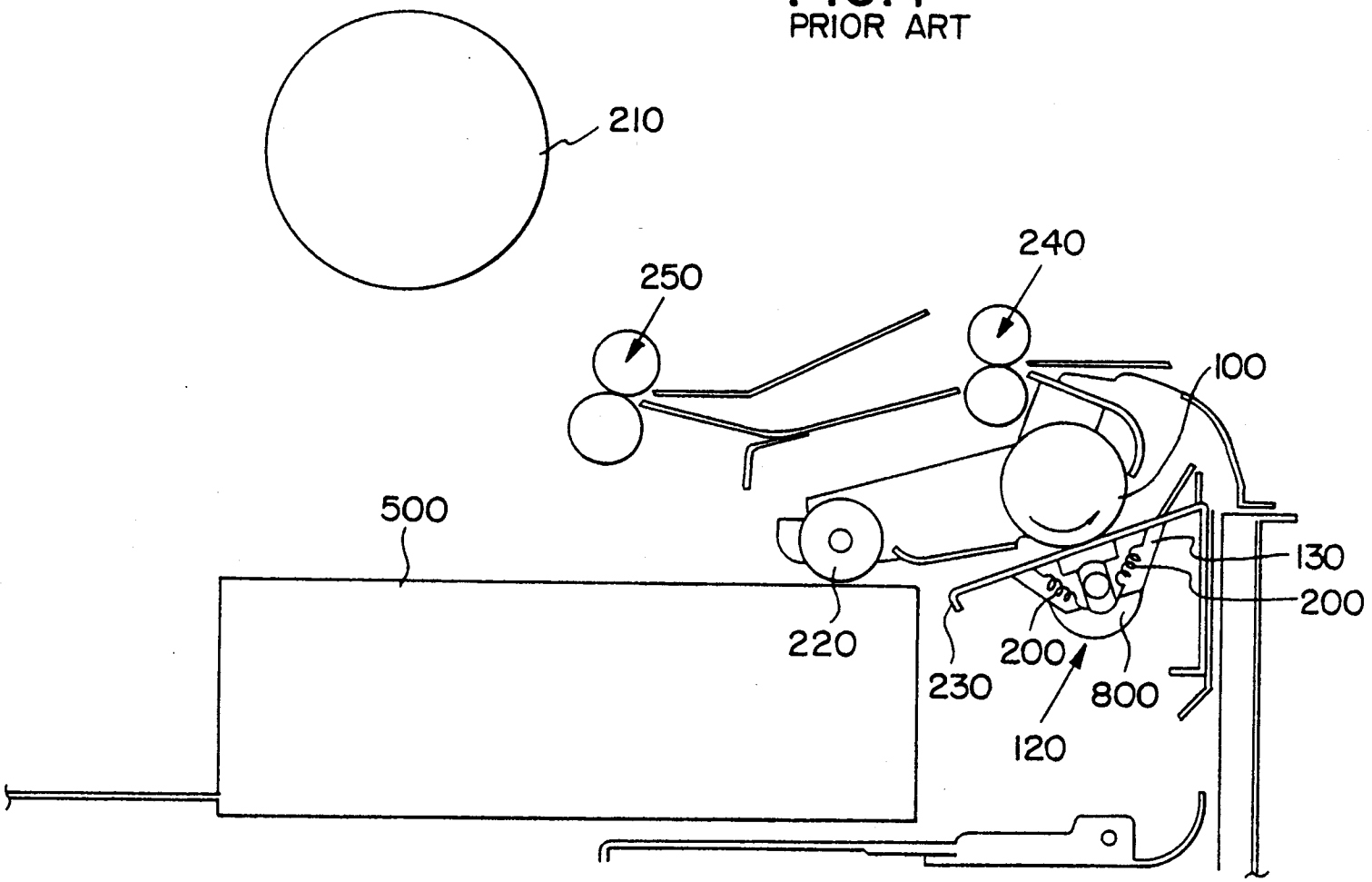
FIG. 1 PRIOR ART
FIG. 1 is a schematic side view showing enlarged principal parts of a sheet feeding mechanism of the prior art.
Figure 2A:
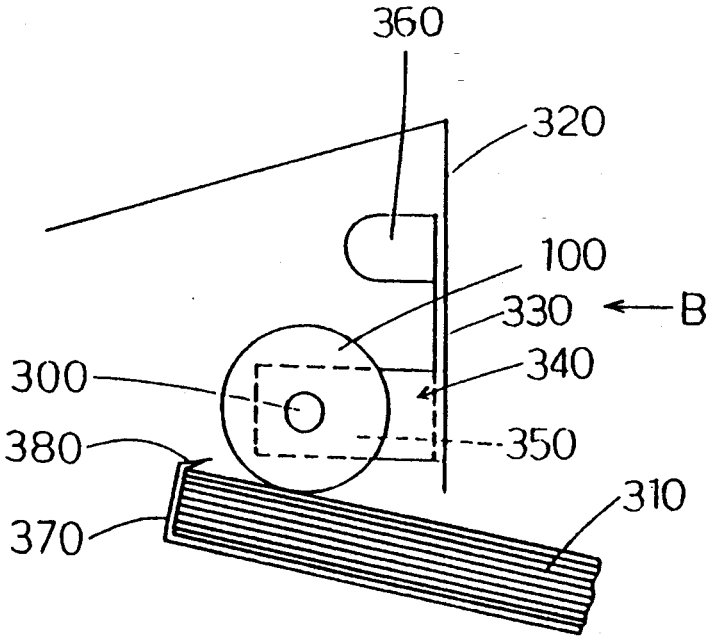
FIG. 2A PRIOR ART
FIGS. 2(*a*) and 2(*b*) are views showing a holding mechanism of the sheet feeding roller of prior art.
Figure 2B:
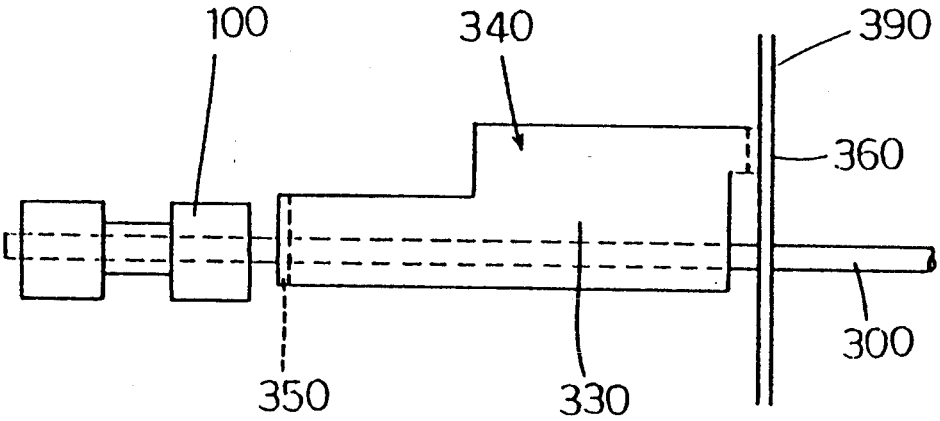
FIG. 2B PRIOR ART
Figure 3:
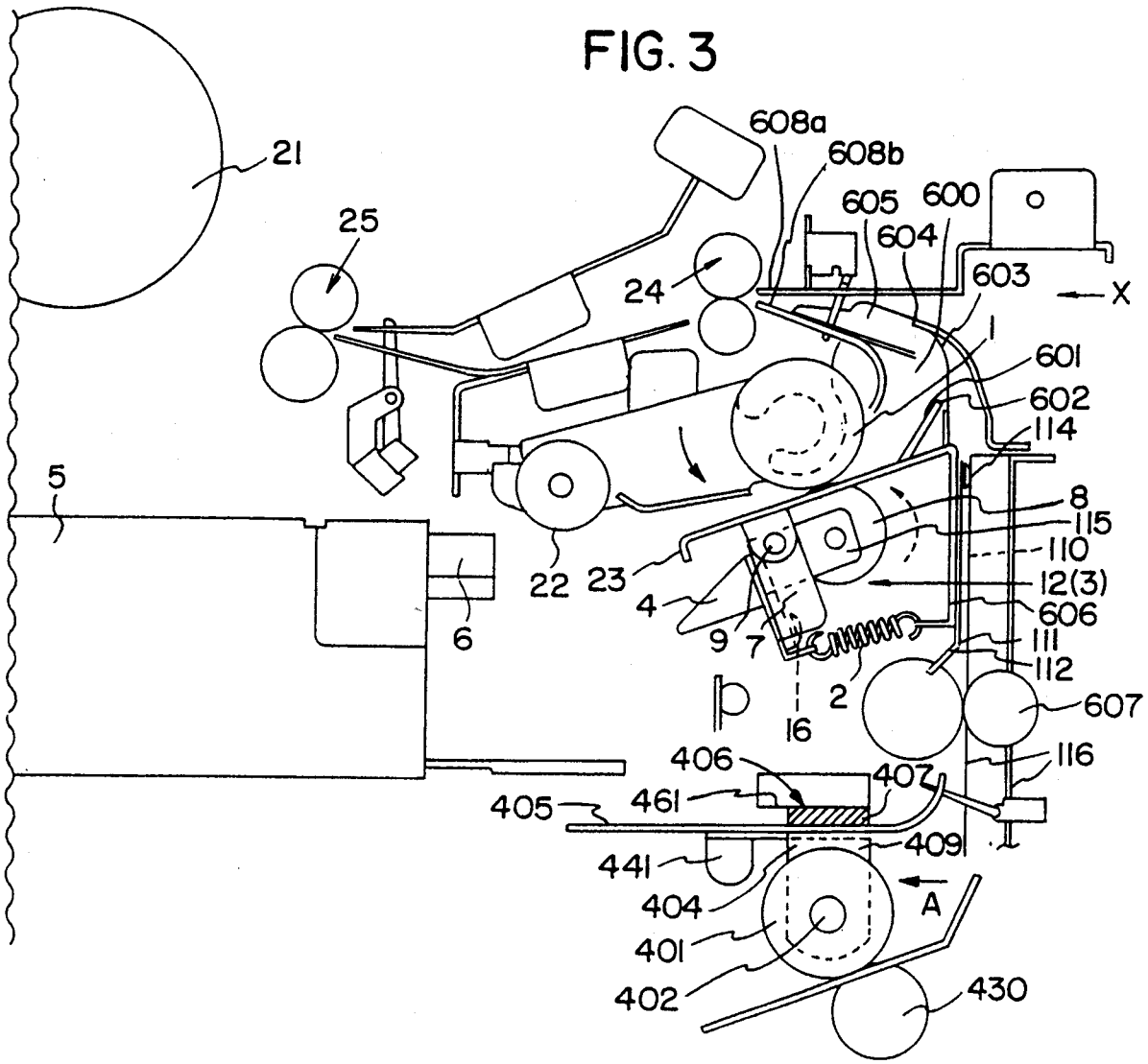
FIG. 3 is a side view showing an embodiment of a sheet feeding mechanism according to the present invention.

FIG. 3 is a side view of part of an image forming apparatus including a sheet feeding mechanism of an embodiment according to the first present invention. That is, the image forming apparatus is provided with a sheet feeding cassette 5 for storing a sheet, a pick up roller 22 for feeding the sheet from the sheet feeding cassette 5, and a guide plate 23 for guiding the sheet having been fed by the pick up roller 22. On the upper central side of the guide plate 23 is provided a sheet feeding roller 1, and on the lower central side of the guide plate 23 is mounted an advance preventive member 3 for preventing multiple sheet feeding in a manner to be abuttable on the sheet feeding roller 1 by a spring 2 being used as an urging means.

On the side further downstream from the guide plate 23 are provided a pair of conveying rollers 24 and a pair of resist rollers 25 in order to feed the sheet to a photosensitive drum 21.

The above-described advance preventive member 3 is formed with a supporting member 9 fixed to the guide plate 23, an arm 7 supported pivotably by the supporting member 9, a friction pad roller 8 which is mounted at one end of the arm 7 and is a pad abuttable on the sheet feeding roller 1, and a protrusion 4 which is an acted part mounted on the sheet feeding cassette 5 side of the arm 7. To the lower end of the arm 7 is connected a spring 2 being urging means for allowing the friction pad roller 8 to abut on the sheet feeding roller 1 by the urging force thereof, and to the lower end of the guide plate 23 is connected the other end of the spring 2.

Figure 6:
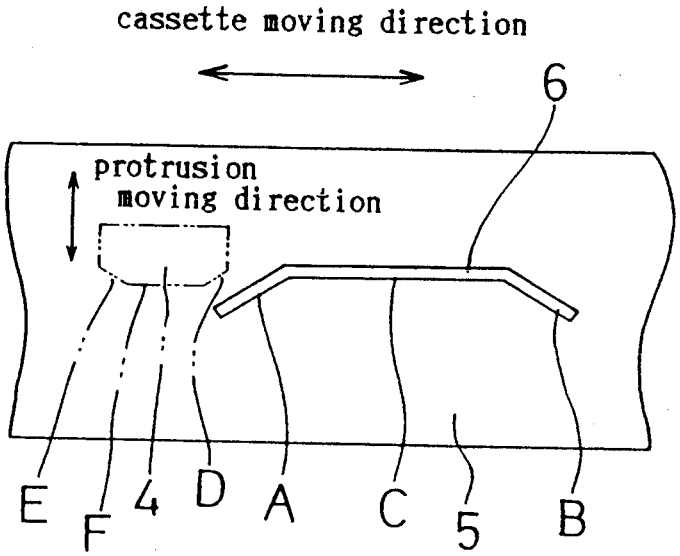
FIG. 6 is a front view to help explain the movement of the advance preventive member associated with the movement of the sheet feeding mechanism according to the present invention.

FIG. 6 is a view showing a relationship in position between the sheet feeding cassette 5 and the protrusion 4 of the advance preventive member 3 as viewed in the X direction of FIG. 3. That is, on the side face on the advance preventive member 3 side of the sheet feeding cassette 5 is provided a rail 6 which acts as an acting part that is formed with downward inclined faces A, B on the both sides and with a face C horizontal in the moving direction on the central part. In FIG. 6, the sheet feeding cassette 5 is allowed to move leftward when pulled out, and rightward when set.

The operation of the above embodiment will be described hereinafter.

Figure 4:
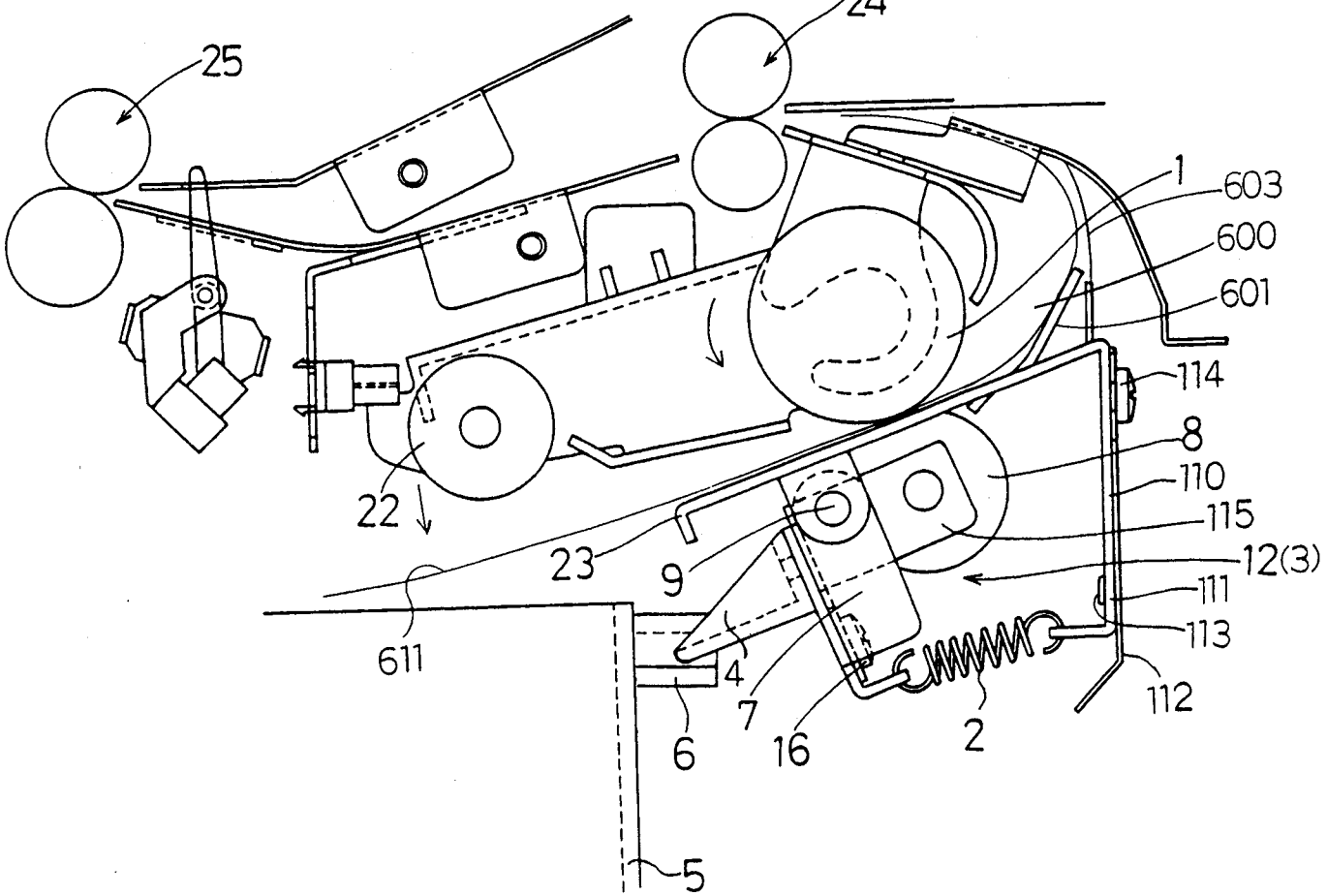
FIG. 4 is a side view showing a state of an embodiment mainly indicating an advance preventive member of the sheet feeding mechanism according to the present invention.

As shown in FIG. 4, when the sheet feeding cassette 5 has been fully pushed-in to a set position (the sheet feeding cassette pulling out direction is vertical to the drawing sheet), or fully pulled out and removed (not shown), the arm 7 has been pivoted counter-clockwise as viewed on the drawing by a pulling force of the spring 2 with the supporting member 9 as an axis, and the friction pad roller 8 has been pivoted in the direction in which it can abut on the sheet feeding roller 1, whereby when the sheet has been fed, the sheet is held between the sheet feeding roller 1 and the friction pad roller 8, and when the sheet has not been fed, the friction pad roller 8 abuts on the sheet feeding roller 1.

When the sheet feeding cassette 5 is used, as shown in FIG. 4, the sheet is fed by the pick up roller 22 to the guide plate 23. The sheet feeding roller 1 rotates in the arrow direction, whereby the sheet is held between the sheet feeding roller 1 and the friction pad roller 8, and conveyed toward the pair of conveying rollers 24. When the pick up roller 22 has fed a plurality of sheets, those sheets are held between the sheet feeding roller 1 and the friction pad roller 8 in a similar manner as for one sheet. However, the friction pad roller 8 not rotating has a friction force larger than that between sheets, which causes the lower side sheets to remain as they are, whereby the sheet feeding roller 1 conveys only the uppermost sheet. When the uppermost sheet has been conveyed, the rotation of the sheet feeding roller 1 stops, and the remaining sheets not conveyed are left held between the sheet feeding roller 1 and the friction pad roller 8.

When sheets are continuously used, the sheets held between the sheet feeding roller 1 and the friction pad roller 8 are first conveyed, and when there are no sheets then sheets should be supplied to the sheet feeding cassette 5, the sheet feeding cassette 5 must be pulled out in a condition that the sheets remain.

Figure 5:
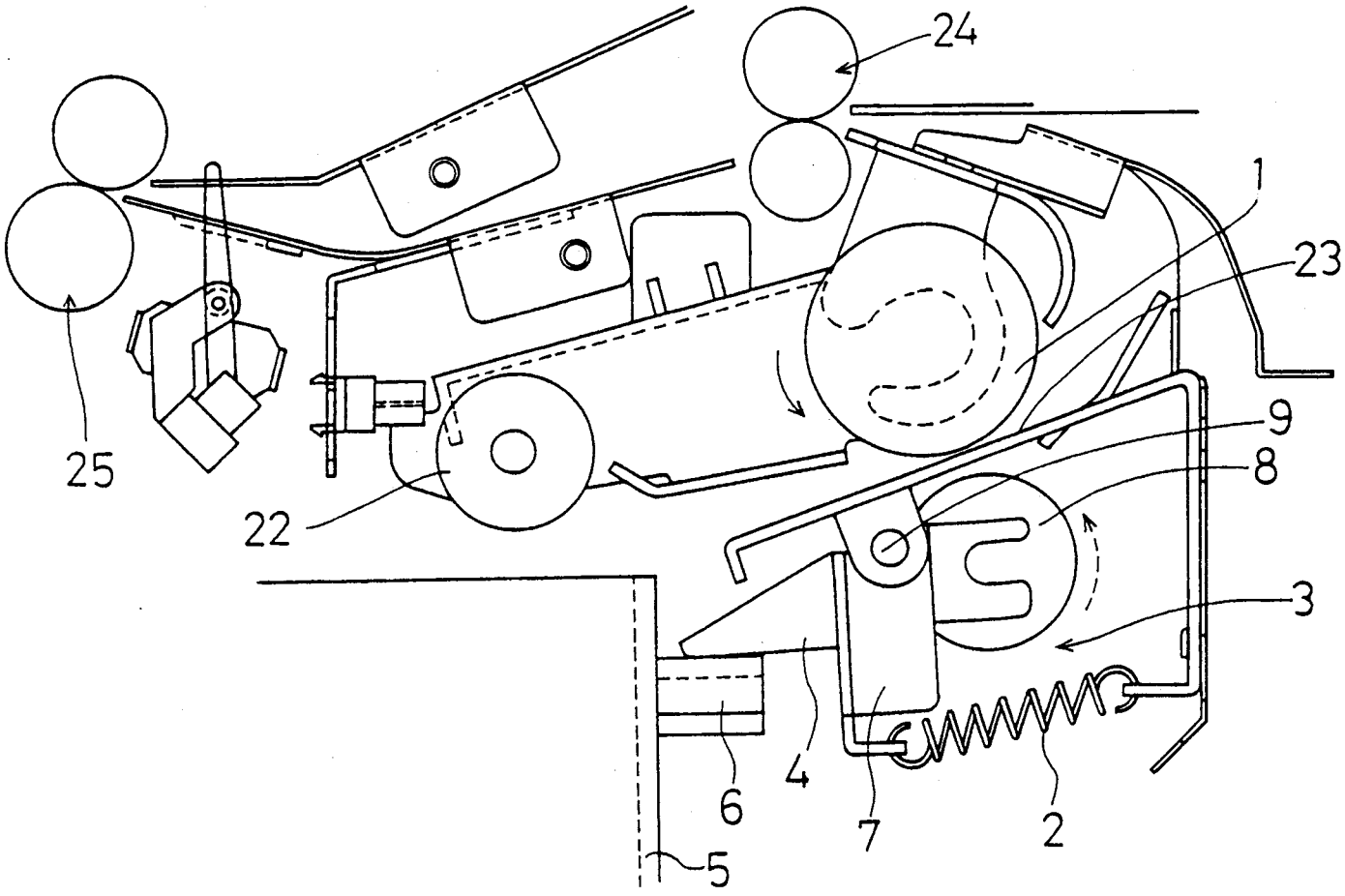
FIG. 5 is a side view showing another state of the embodiment mainly indicating the advance preventive member of the sheet feeding mechanism according to the present invention.

Now, pulling out the sheet feeding cassette 5 in order to supply sheets to the sheet feeding cassette 5 causes the inclined face A of the rail 6 provided on the side face of the sheet feeding cassette 5 to abut on an inclined corner face D of the protrusion 4, whereby the protrusion 4 is pushed upward in association with the movement (leftward) of the sheet feeding cassette 5, as shown in FIG. 6. At this point, from the time immediately after the abutting of the protrusion 4, the friction pad roller 8 moving concurrently with the protrusion 4 rotates clockwise with the supporting member 9 as a rotating axis, and begins to be separated from the sheet feeding roller 1, thereby releasing the holding of the sheets remaining between the sheet feeding roller 1 and the friction pad roller 8 (refer to FIG. 5).

Then, when the abutting position shifts from the inclined face A to the horizontal face C of the rail 6, the horizontal face C abuts on an under face F of the protrusion 4, and the remaining sheets are held at the rear end thereof by a sheet separating jaw (not shown) of the sheet feeding cassette 5, whereby the sheets are pulled out together with the sheet feeding cassette 5. During this operation, the protrusion 4 is pushed upward, and the friction pad roller 8 is separated from the sheet feeding roller 1 (refer to FIG. 5).

When the sheet feeding cassette 5 is further pulled out, the abutting position of the rail 6 on the protrusion 4 shifts from the horizontal face C to the inclined face B, whereby the inclined face B abuts on an inclined face E of the protrusion 4. When the protrusion 4 is returned to the lower side in association with the movement of the sheet feeding cassette 5 and thus the inclined face E of the protrusion 4 is separated from the inclined face B, the protrusion 4 is also returned to the original position by the spring 2 to cause the friction pad roller 8 to abut on the sheet feeding roller 1 (refer to FIG. 4). Needless to say, the sheets remaining between the sheet feeding roller 1 and the friction pad roller 8 have been drawn together with the sheet feeding cassette 5 before the protrusion 4 is separated from the inclined face B of the rail 6.

Figure 7:
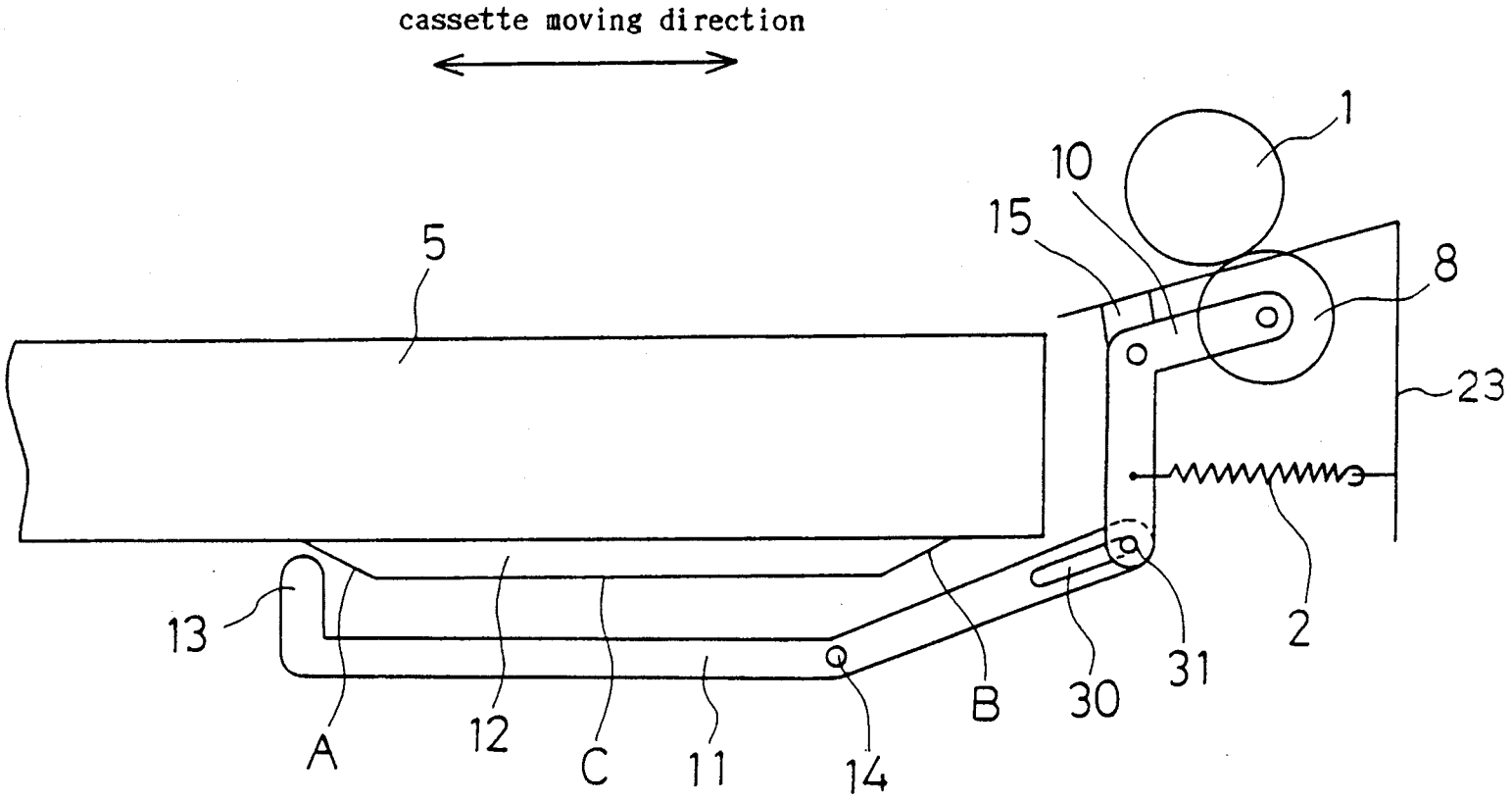
FIG. 7 is a front view to help explain of the movement of the advance preventive member associated with the movement of the sheet feeding mechanism according to the present invention.

FIG. 7 shows a sheet feeding mechanism of another embodiment. In this embodiment, the sheet feeding cassette 5 is pulled up or set leftward/rightward on the drawing.

On the underside of the sheet feeding cassette 5, moving in the arrow direction when set/pulled out, is provided a protrusion 12 having a horizontal part C long in the moving direction and inclined faces A, B at both ends thereof. On the lower side of the protrusion 12 is provided a lever 11.

On the central part of the lever 11 is provided a pivoting shaft 14, and at one end on the left side on the drawing is provided an abutting protrusion 13 in a manner to be close to the inclined face A of the protrusion 12. At the other end of the lever 11 is provided a guide groove 30, into which a movable shaft 31 is fitted, and the shaft 31 is mounted at one end of an arm 10. The arm 10 is pivotably supported by a supporting member 15. To the shaft 31 side of the arm 10 is connected the spring 2, and at the other end is mounted the friction pad roller 8 which abuts on the sheet feeding roller 1 by the urging force of the spring 2. The other end of the spring 2 is connected to one end of the guide plate 23, to which the above-described supporting member 15 is mounted.

Now, pulling out the sheet feeding cassette 5 (moving leftward on the drawing) in a condition that a sheet is held between the sheet feeding roller 1 and the friction pad roller 8 causes the inclined face A of the protrusion 12 on the underside to abut on the abutting protrusion 13 of the lever 11, whereby the abutting protrusion 13 is pushed downward and the lever 11 begins to pivot. Then, the guide groove 30 side of the lever 11 moves upward to cause the shaft 31 to move leftward in the guide groove 30, and the arm 10 to be pivoted clockwise against the force of the spring 2. When the arm 10 is pivoted, the friction pad roller 8 is separated from the sheet feeding roller 1 to release the sheet. When the sheet feeding cassette 5 moves further, the abutting protrusion 13 abuts on the horizontal part C of the protrusion 12 to keep a condition that the friction pad roller 8 is separated from the sheet feeding roller 1, whereby the sheet is pulled out together with the sheet feeding cassette 5. Then, when the sheet has been pulled out and the sheet feeding cassette 5 is further pulled out, the abutting protrusion 13 is returned to the original position while abutting on the inclined face B of the protrusion 12, and the lever 11 is also returned to the original position, whereby the friction pad roller 8 abuts again on the sheet feeding roller 1.

Although in the above-described embodiment, the pad roller is allowed to be separated from the sheet feeding roller by pivoting the arm, in addition to such method, the pad roller may be moved upward/downward in the guide groove provided to the supporting member as in the prior art, and the rail may be allowed to move a protrusion provided on the pad roller itself.

Although in the above-described embodiment, a mechanical method is utilized, in addition to such method, an electrical method may be utilized in which, for example, a micro-switch is mounted to an acted part of the advance preventive member and a protrusion is formed at a position of the sheet feeding cassette close to the micro-switch in a condition that the sheet feeding cassette is set to the sheet feeding cassette position, whereby when the sheet feeding cassette is pulled out, the protrusion pushes the micro-switch to cause a solenoid mounted to the guide plate to pull the acted part of the advance preventive member for a specified time, and thus to allow the pad roller to pivot in a manner to be separated from the sheet feeding roller.

As apparent by the above description, the present invention has an advantage that when sheet feeding cassette is pulled out, the sheet remaining at the pick up roller is not wrinkled and torn.

The sheet feeding mechanism of an embodiment according to the second present invention will be explained hereinafter. The embodiment is almost similar to the embodiment of the first invention, but the friction pad roller 8, and the guide means 6 and so on are different.

Figure 8:
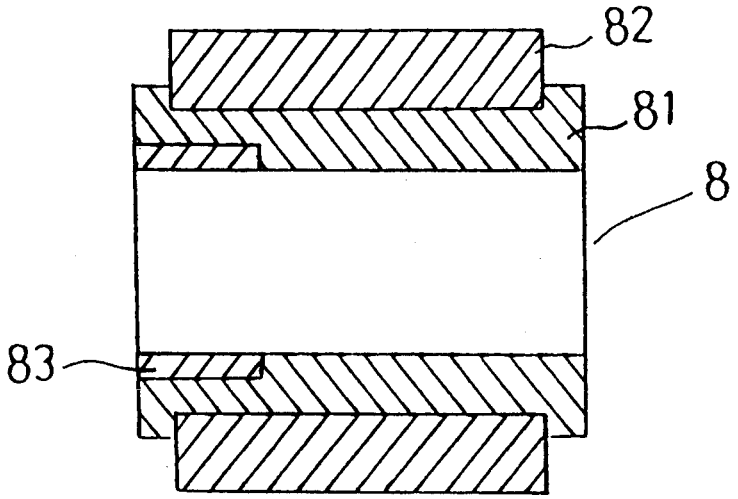
FIG. 8 is a member view showing the internal structure of a friction pad roller of the advance preventive member of the sheet feeding mechanism according to the present invention.

FIG. 8 is a sectional view of the friction pad roller 8 of the advance preventive member 3 in FIG. 3. As shown in FIG. 8, the friction pad roller 8 is formed by mounting a pad 82 allowed to abut on the sheet feeding roller 1 on the surface of a collar 81 provided with a one-way clutch 83 having a mechanism rotatable only in one direction, and mounted at one end of the arm 7 in a manner to be rotatable reversely to the sheet feeding direction (rotatable only in the dotted-line arrow direction of FIG. 3).

Figure 9:
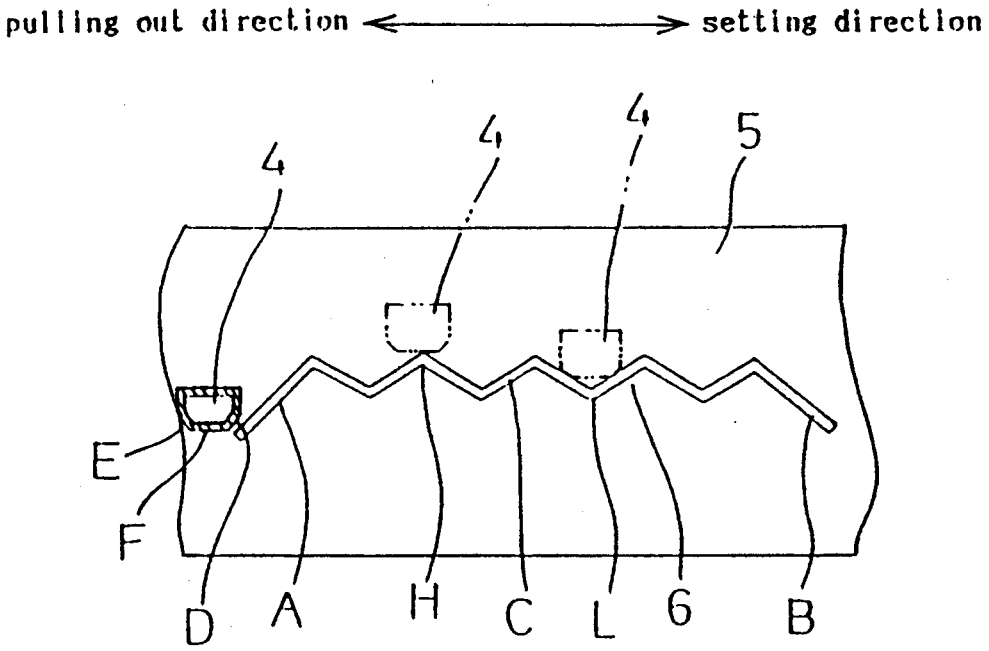
FIG. 9 is a front view to help explain of the movement of the advance preventive member associated with the movement of the sheet feeding mechanism according to the present invention.

On a side face on the advance preventive member 3 side of the sheet feeding cassette 5 is provided guide means 6 having downward inclined faces A, B on both ends and a central part formed with triangle wave face C, as shown in FIG. 9. That is, FIG. 9 is a view showing a relationship in position between the sheet feeding cassette 5 and the protrusion 4 of the advance preventive member 3 as viewed in the X direction of FIG. 3. In FIG. 9, the sheet feeding cassette 5 is allowed to move leftward when pulled out, and rightward when set.

The operation of the above embodiment will be described hereinafter.

As described above and shown in FIG. 4, when the sheet feeding cassette 5 has been fully pushed in to a set position (the sheet feeding cassette pulling out direction is perpendicular to the drawing), or pulled out and removed (not shown), the arm 7 is pivoted counterclockwise as viewed on the drawing by the spring 2 with the supporting member 9 as an axis, and the friction pad roller 8 abuts on the sheet feeding roller 1.

When the sheet feeding cassette 5 is used (FIG. 4), the sheet is fed by the pick up roller 22 to the guide plate 23. The sheet feeding roller 1 rotates in the arrow direction, whereby the sheet is held between the sheet feeding roller 1 and the friction pad roller 8, and conveyed toward the pair of conveying rollers 24. Where a plurality of sheets are fed, the friction pad roller 8 is fixed without being rotated in the sheet feeding direction because of the one-way clutch 83, so that the friction force causes the lower side sheets to remain as they are, whereby the sheet feeding roller 1 conveys only the uppermost sheet, thus preventing the multiple sheet feeding. Then the abutting part of the friction pad roller 8, on which the sheet feeding roller 1 abuts, wears at the same part at all times without moving.

Now, pulling out the sheet feeding cassette 5 in order to supply sheets to the sheet feeding cassette 5 causes the inclined face A of the guide means 6 provided on the side face of the sheet feeding cassette 5 to abut on an inclined corner face D of the protrusion 4, whereby the protrusion 4 is pushed upward in association with the movement (leftward) of the sheet feeding cassette 5. At this point, from the time immediately after the abutting of the protrusion 4, the friction pad roller 8 moving concurrently with the protrusion 4 rotates clockwise with the supporting member 9 as a rotating axis, and begins to be separated from the sheet feeding roller 1, whereby the friction pad roller 8 becomes free to rotate.

Then, when the abutting position shifts from the inclined face A to the triangle wave face C of the guide means 6, the triangle wave face C abuts sequentially on the under face F and the inclined corner faces E, D, and the shifting of the abutting causes the protrusion 4 to move repeatedly upward/downward (from the H to L of FIG. 9). The shock of the upward/downward movement is transmitted through the arm 7 to the friction pad roller 8, and the vibration of that shock causes the friction pad roller 8 to rotate a little in the dotted-line arrow direction of FIG. 5 in which the roller is rotatable at all times since the friction pad roller 8 cannot rotate the reverse direction because of the one-way clutch 83.

When the sheet feeding cassette 5 is further pulled out, the abutting position of the guide means 6 on the protrusion 4 shifts from the triangle wave face C to the inclined face B of the guide means 6, and thus the inclined face B abuts on the inclined corner face E of the protrusion 4. In association with the movement of the sheet feeding cassette 5, the protrusion 4 is returned to the lower side, the inclined corner face E of the protrusion 4 is separated from the inclined face B, and thus the guide means 6 for pushing up the protrusion 4 is separated, whereby the protrusion 4 is returned to the original position by the spring 2 to cause the friction pad roller 8 to abut on the sheet feeding roller 1 (refer to FIG. 4). At this point, the friction pad roller 8 had already been rotated a little, so that the abutting part of the pad 82 has shifted to another position.

Where sheets are supplied to the sheet feeding cassette 5 to set (the sheet feeding cassette moves rightward in FIG. 9), the protrusion 4 moves upward/downward in a similar manner to the above-described pulling out, while the friction pad roller 8 is separated from the sheet feeding roller 1, thereby giving a vibration to the friction pad roller 8 to change the abutting position of the pad 82.

Such a little rotation of the friction pad roller 8 due to vibration occurs random, so that with long-term usage, the circumferential whole surface of the pad 82 is substantially evenly abutted.

Although in the above-described embodiment, the protrusion provided to the arm is allowed to be acted directly by the guide means, the protrusion may be allowed to be acted indirectly through an intermediate lever by providing the guide means in another position of the sheet feeding cassette.

Figure 10A:
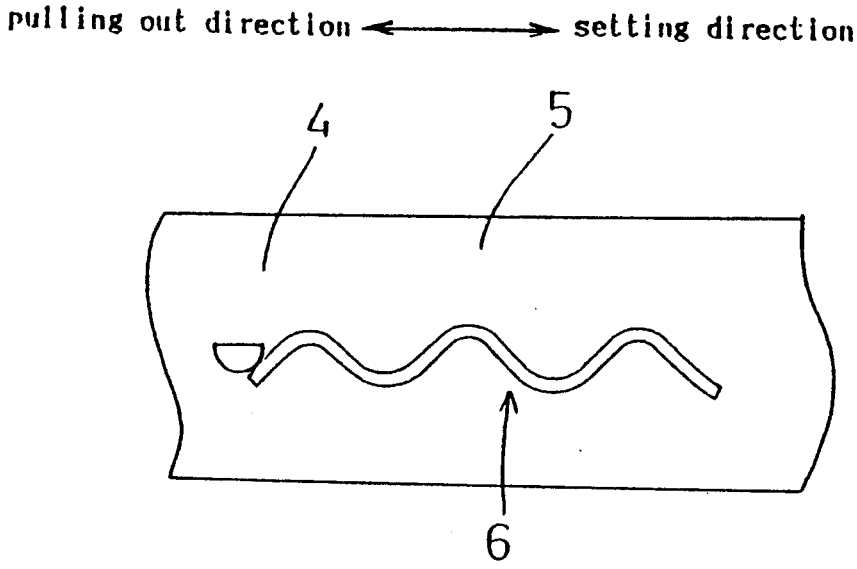
FIGS. 10(*a*) and 10(*b*) are front views to help explain movement of the advance preventive member associated with the movement of the sheet feeding mechanism according to the present invention.
Figure 10B:
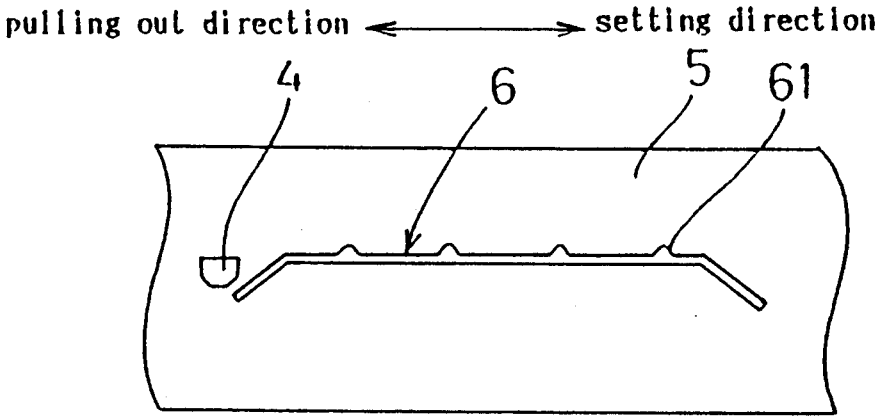

Although in the above-described embodiment, the guide means has a shape of a triangle wave face, in addition to such shape, a wave face as shown in FIG. 10 (a), or a plurality of protrusions on the upper side of the horizontal face as shown in FIG. 10 (b) may be provided. Alternatively, a flat face may be provided, in which case a little vibration due to the pulling out/setting of the sheet feeding cassette occurs and is transmitted to the pad to allow a little rotation.

As apparent by the above description, the present invention has an advantage that the life of the friction pad roller becomes longer, and the equipment is simple in structure and requires no special operation.

With reference to drawings, embodiments of the third present invention will be described hereinafter.

FIG. 3 is a member view of part of an image forming apparatus provided with multiple feeding preventive equipment of an embodiment according to the third present invention. That is, the image forming apparatus is provided with a sheet feeding cassette 5 for storing a sheet, a pick up roller 22 for feeding the sheet from the sheet feeding cassette 5, and a guide plate 23 for guiding the sheet having been fed by the pick up roller 22. On the upper central side of the guide plate 23 is provided a sheet feeding roller 1, and on the lower central side of the guide plate 23 is mounted an advance preventive member 3 for preventing multiple sheet feeding in a manner to be abuttable on the sheet feeding roller 1 by a spring 2 being used as an urging means. A side plate 111 provided with an opening 110 for maintenance and checking is connected downward to the end on the downstream side of the guide plate 23. A cover plate 112 with a jaw 113 (refer to FIG. 4) and machine screws 114 is mounted to the opening 110.

On the side further downstream from the guide plate 23 are provided a pair of conveying rollers 24 and a pair of resist rollers 25 in order to feed the sheet to a photo sensitive drum 21.

As shown in FIG. 4, the above-described friction pad roller 8 is mounted to an L-shaped pad mounting plate 115 to constitute a pad means 12 of the advance preventive means 3. The pad mounting plate 115 is fixed with a machine screw 16 to a bottom plate of a U sectional-shaped pad supporting arm 7, which is pivotably supported by the supporting member 9 provided to the guide plate 23. To the lower end of the pad supporting arm 7 is connected one end of the spring 2 being urging means for allowing the friction pad roller 8 to abut on the sheet feeding roller 1 by the urging force thereof, and to the lower end of the side plate 111 is connected the other end of the spring 2.

The operation of the above embodiment will be described hereinafter.

When the friction pad roller 8 wears due to long-term usage, the roller must be replaced with a new one. At this point, the power source of the image forming apparatus is first to be opened, and a side door 116 shown in FIG. 3 is to be opened.

Figure 11:
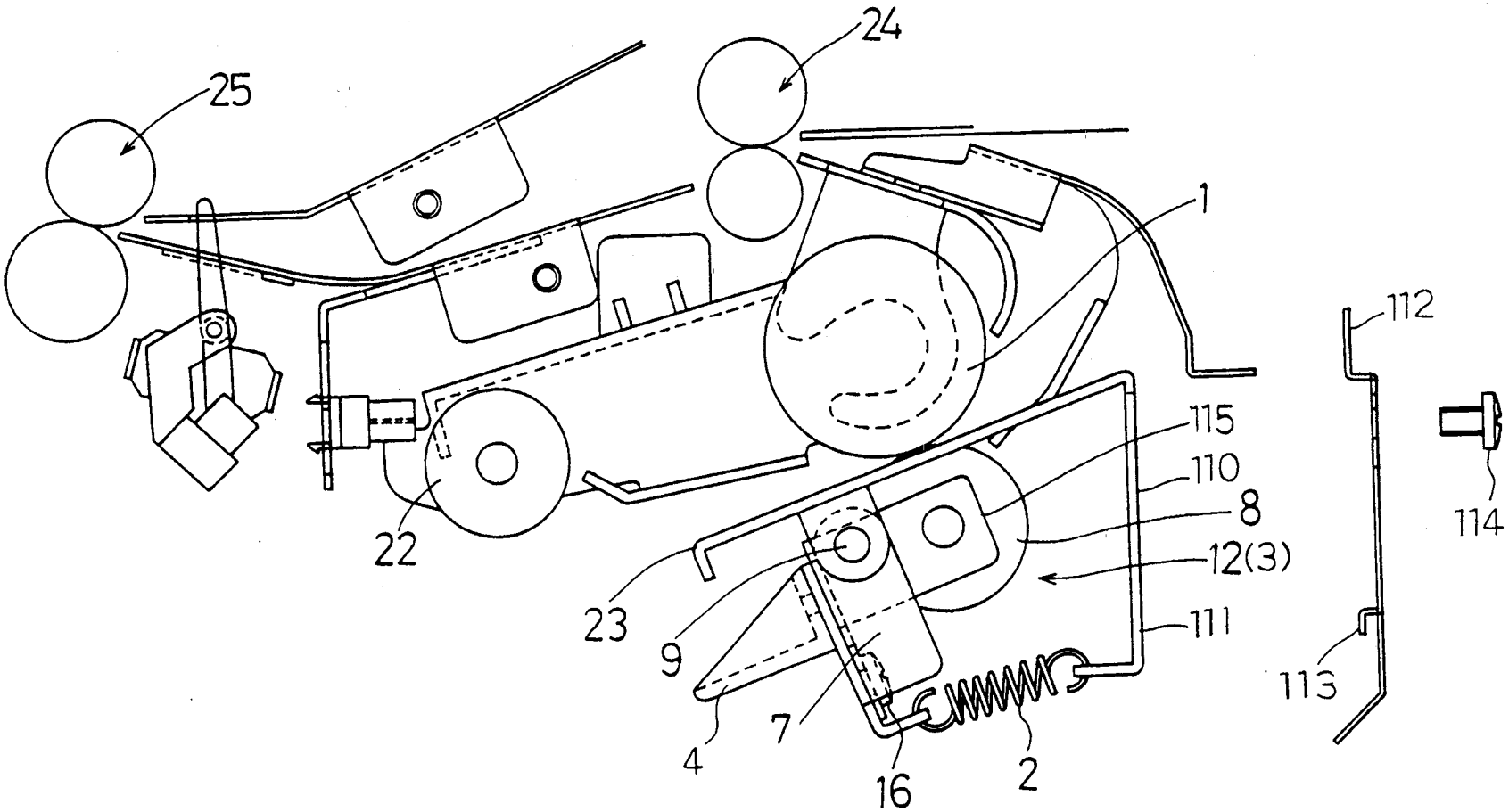
FIG. 11 is a side view showing a state of an embodiment mainly indicating an advance preventive member of the sheet feeding mechanism according to the present invention.

Opening the side door 116 allows the cover plate 112 blocking the opening 110 of the side plate 111 to be found. Then, as shown in FIG. 4 both side machine screws 114 mounting the cover plate 112 are to be loosened and removed. After removing the machine screws 114, the cover plate 112 is to be removed in such a manner that as shown in FIG. 11, the cover plate 112 is to be raised a little so as to pull out a jaw 113 hooking at the lower end edge of the opening 110. When the cover plate 112 is removed, the opening 110 is opened to allow the inner friction pad roller 8 and the pad supporting arm 7 to be found.

Figure 12:
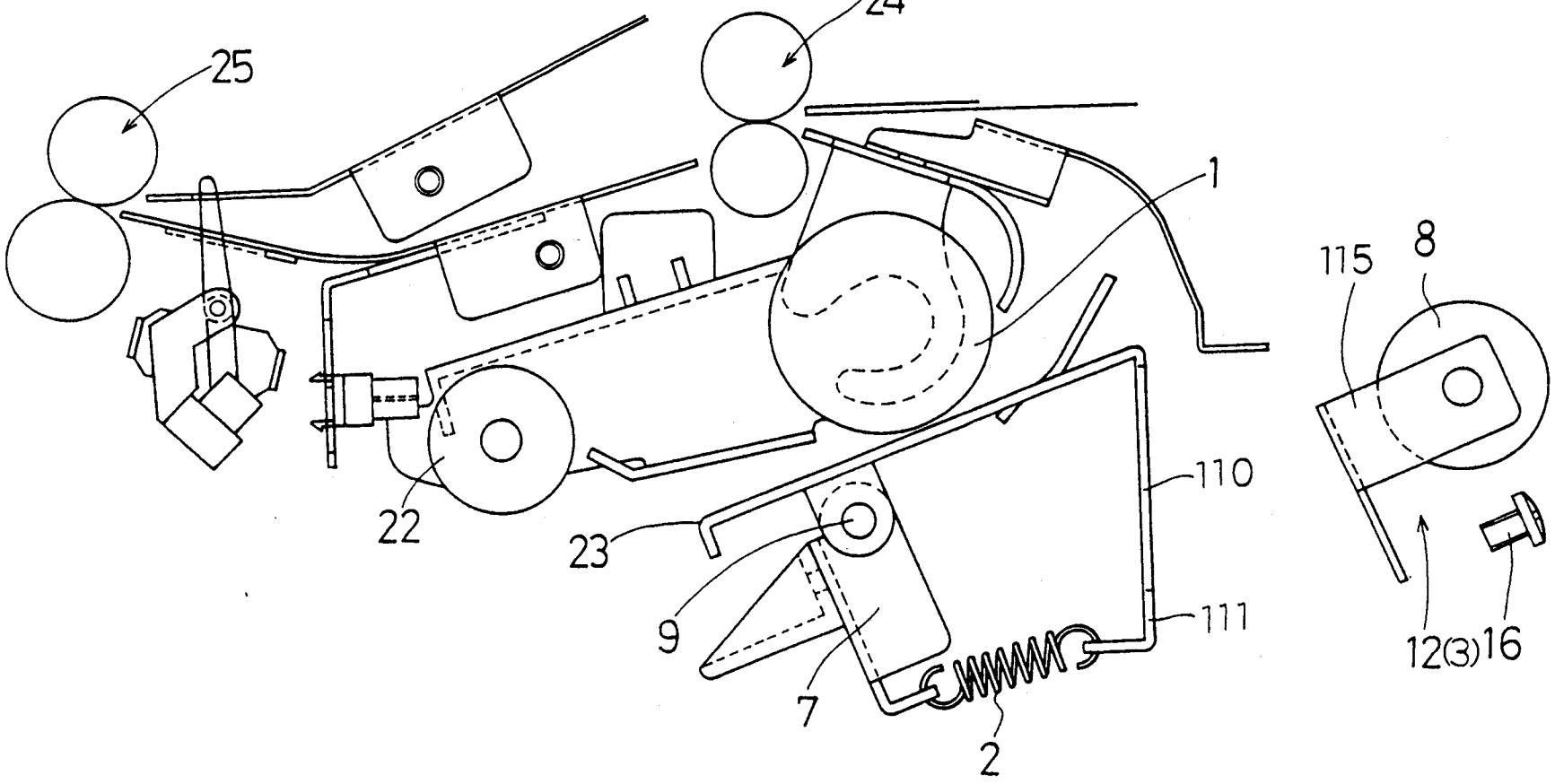
FIG. 12 is a side view showing another state of the embodiment mainly indicating the advance preventive member of the sheet feeding mechanism according to the present invention.

Then, loosening a machine screw 16 while supporting the friction pad roller 8 with hands through the opening 110 allows the pad mounting plate 115 and the friction pad roller 8 to be separated from the pad supporting arm 7 as shown in FIG. 12, so that they are to be pulled out of the opening 110.

Then, a new friction pad roller 8 mounted to the pad mounting plate 115 is to be inserted from the opening 110 and fastened and fixed with the machine screw 16 to the pad supporting arm 7 in a similar manner to the above. In order to return the cover plate 112 to the original position, the jaw 113 on the lower side of the cover plate 112 is hooked at the lower end edge of the opening 110, and the upper side of the cover plate 112 is fastened and fixed with the machine screws 114.

Thus, when the friction pad roller 8 is replaced, it is not necessary to remove the spring 2, so that the urging force of the spring 2 does not change.

Figure 13:
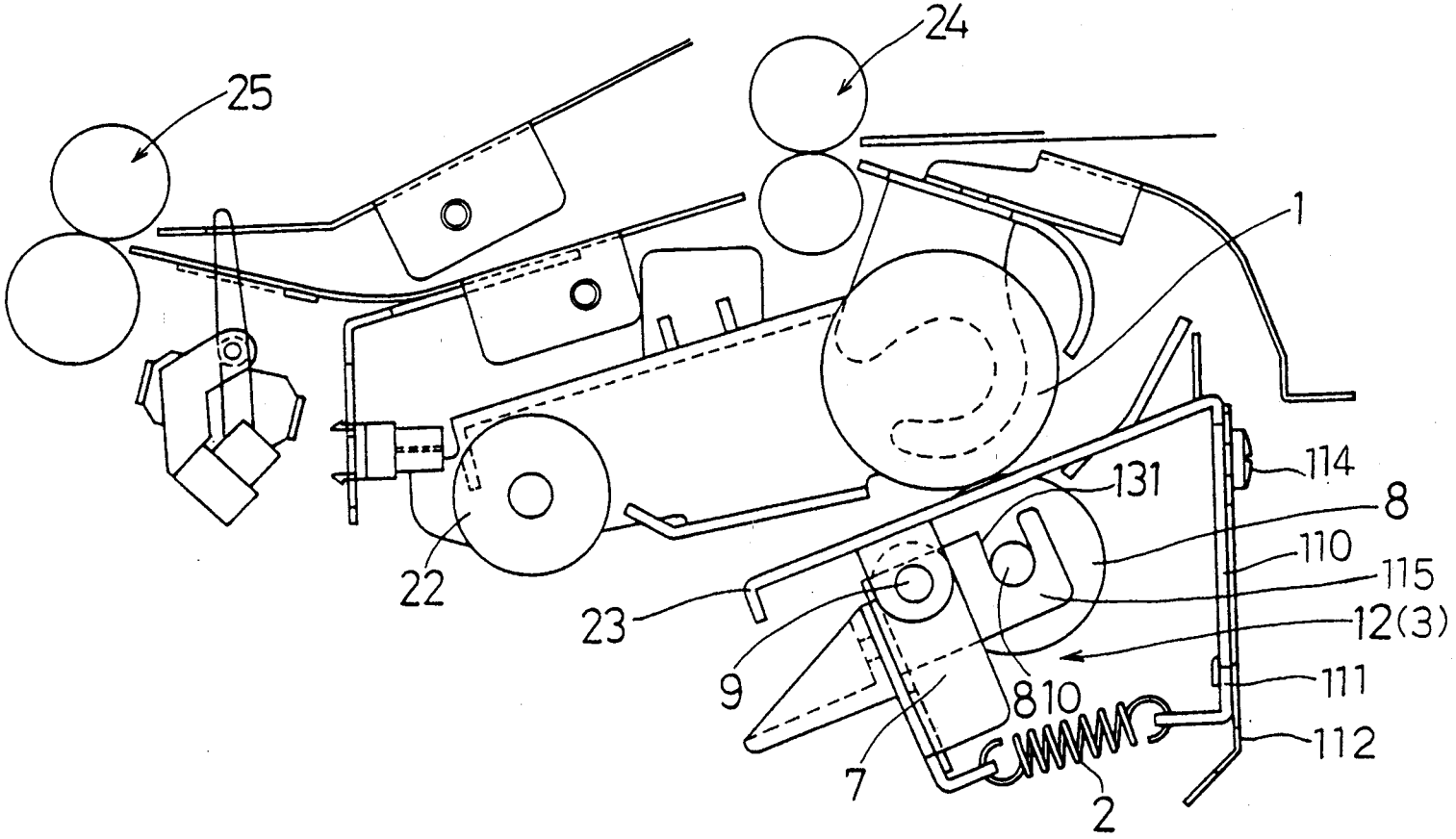
FIG. 13 is a side view showing another state of the embodiment mainly indicating the advance preventive member of the sheet feeding mechanism according to the present invention.
Figure 14:
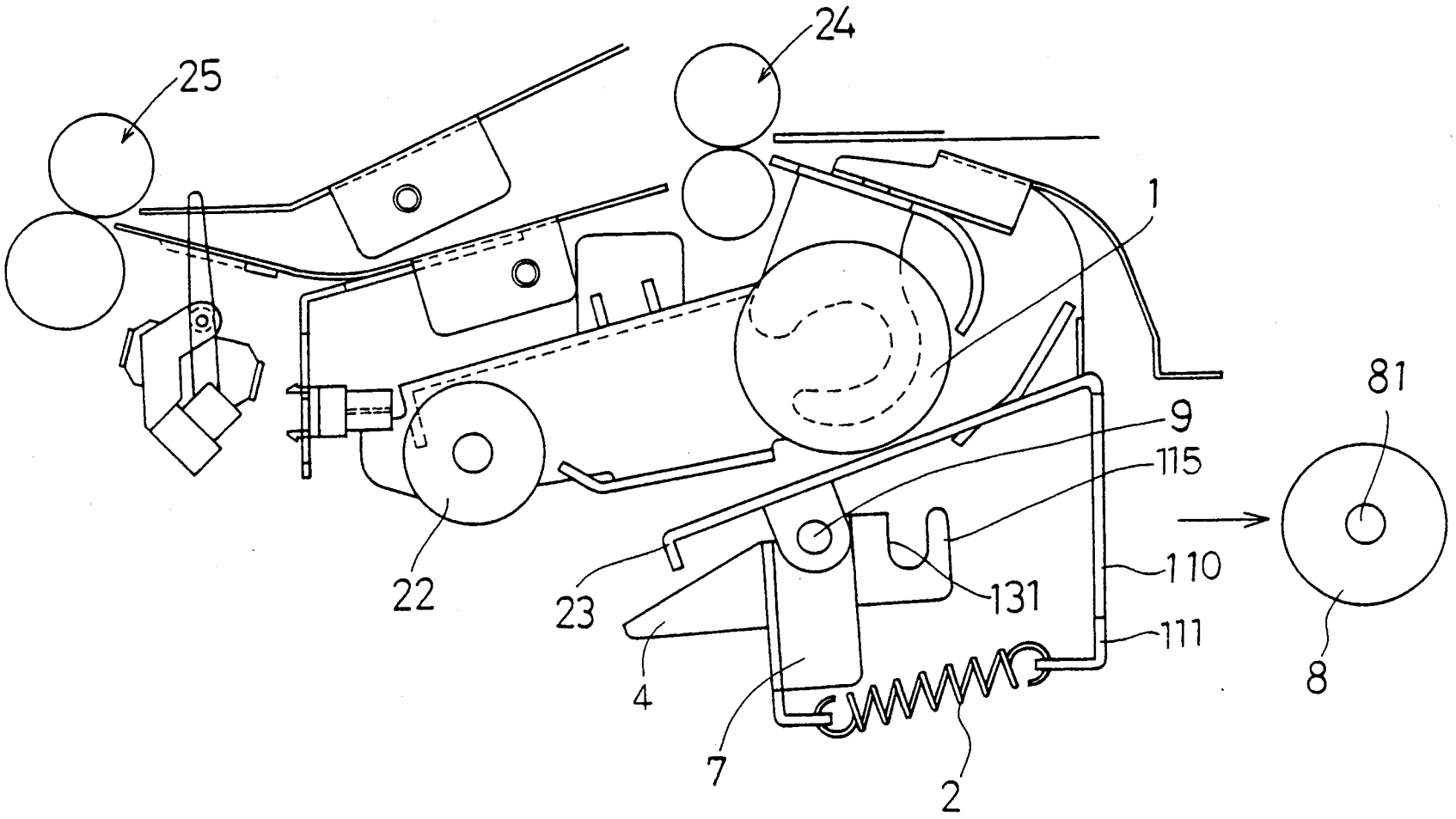
FIG. 14 is a side view showing another state of the embodiment mainly indicating the advance preventive member of the sheet feeding mechanism according to the present invention.

FIGS. 13 and 14 show another embodiment.

In FIG. 13, the opening 110 is provided to the side plate 111 similarly to the above-described embodiment. In order that the friction pad roller 8 is removable, a shaft 810 is fitted into a U-shaped dent 131 of the pad mounting plate 115, which is fixed to the pad supporting plate 7.

A worn friction pad roller 8 os to be replaced in a similar manner to the above by opening a side cover 116, removing the cover plate 112 from the side plate 111, opening the opening 110, pushing the lower side of the pad supporting plate 7 to the inner side to pivot the pad supporting plate 7 through the opening 110 by a hand, separating the friction pad roller 8 from the sheet feeding roller 1, and pulling out a friction pad roller shaft 810 to a near side while shifting out from the dent 113 (refer to FIG. 14). Then, the shaft 810 of a new friction pad roller 8 is to be fitted into the dent 131 while the lower side of the pad supporting plate 7 remains pushed to the inner side. When the pushing stops, this causes the pad supporting plate 7 to be returned to the original position by the spring 2, whereby the friction pad roller 8 abuts on the sheet feeding roller 1.

Although in the above-described embodiment, a machine screw is used for fixing the pad mounting plate, a quick fitting construction such as a hooking jaw and a holding fixture may be used if they provide a certainly positive fixing.

As apparent by the above description, the present invention has an advantage that before and after the replacement of the friction pad roller, the urging force of the spring does not change to cause a poor sheet feeding to occur.

With reference to the drawings, embodiments of the fourth present invention will be described hereinafter.

As shown in FIG. 3, on a part of an image forming apparatus is provided the sheet feeding cassette 5 storing sheets for a first conveying passage 600. On the upper side of the sheet feeding cassette 5 is provided the pick up roller 22, on the downstream side of which is provided the guide plate 23 for guiding sheets, in the midway of which is provided the sheet feeding roller 1 for conveying the sheets on the upper side, and the friction pad roller 8 for preventing the multiple sheet feeding on the lower side. On the guide plate 23 is provided an inclined face 601 for guiding the sheets to the downstream side of the friction pad roller 8, and the passage from the sheet feeding roller 1 to the inclined face 601 forms the first conveying passage 600. To a joining point close to a tip head of the inclined face 601 is mounted guide means 603. The tip head 604 is provided in a manner to abut on the inner wall on the upper side of a third conveying passage 605.

On the lower side of the sheet feeding cassette 5 are provided another sheet feeding cassette, pick up roller (which are not shown), guide plate, sheet feeding roller 401, and friction pad roller 430 in a similar manner to the above, and on a downstream side of the guide plate is provided a conveying roller 607 for conveying sheets to a second conveying passage 606. The second conveying passage 606 joins with the above-described first conveying passage 600 to form the third conveying passage 605.

On the downstream side of the third conveying passage 605 are formed two guide plates 608*a*, 608*b* for guiding the sheets, close to the downstream side of which are provided the pair of conveying roller 24.

Figure 16:
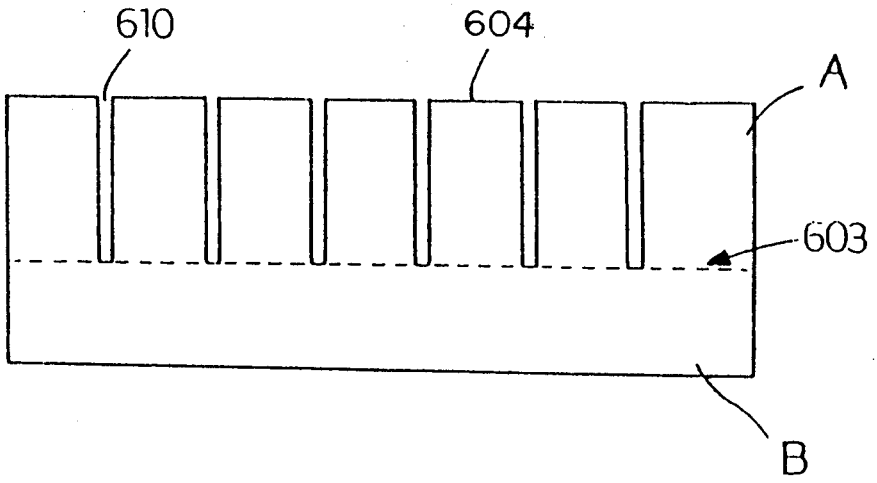
FIG. 16 is a front view of the guide means provided in conveying passages of the sheet feeding mechanism according to the present invention.
Figure 17A:
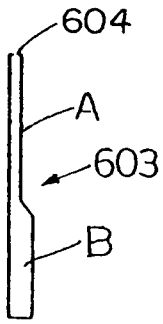
FIGS. 17(*a*) through 17(*d*) are side views of various guide means provided in conveying passages of the sheet feeding mechanism according to the present invention.
Figure 17B:
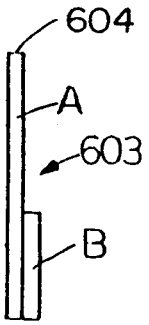
Figure 17C:
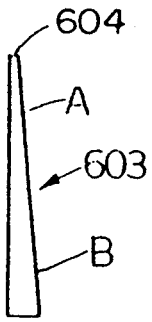
Figure 17D:
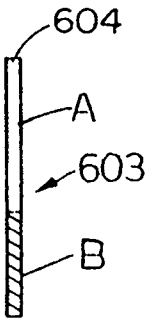

FIG. 16 is a plan view of the guide means 603 of the above-described embodiment.

As shown in FIG. 16, in order to make part A of the thin plate-like resilient guide means 603 more flexible than part B thereof, on the part A are provided a plurality of slits 610 having a specified length from the head 604 thereof, while the part B is left as it is.

The operation of the above embodiment will be described hereinafter.

In FIG. 3, when the upper sheet feeding cassette 5 is selected in order to transfer a toner image formed on the photosensitive drum 21, the pick up roller 22 feeds the sheet stored in the sheet feeding cassette 5 toward the sheet feeding roller 1. The fed sheet is fed along the face of the guide plate 23 by the sheet feeding roller 1 rotating in the arrow direction to the first conveying passage 600. At this point, if a plurality of overlapped sheets are fed to the sheet feeding roller 1, the sheets on the lower side are not conveyed due to the friction force of the friction pad roller 8 on the lower side, and only the uppermost one sheet abutting on the sheet feeding roller 1 is fed.

As shown in FIG. 4, when a sheet 611 is fed to the first conveying passage 600, the sheet 611 is moved along the inclined face 601 in the diagonally upper right direction, and the leading edge of the sheet 611 hits the part B of the guide means 603 to cause the conveying direction thereof to be bent leftward. At this point, the sheet 611 is conveyed along the face of the guide means 603 toward the pair of the conveying rollers 24 while absorbing a deflection (bent) usually occurring in the sheet 611 by the elastic force of the part B of the guide means 603.

Figure 15:
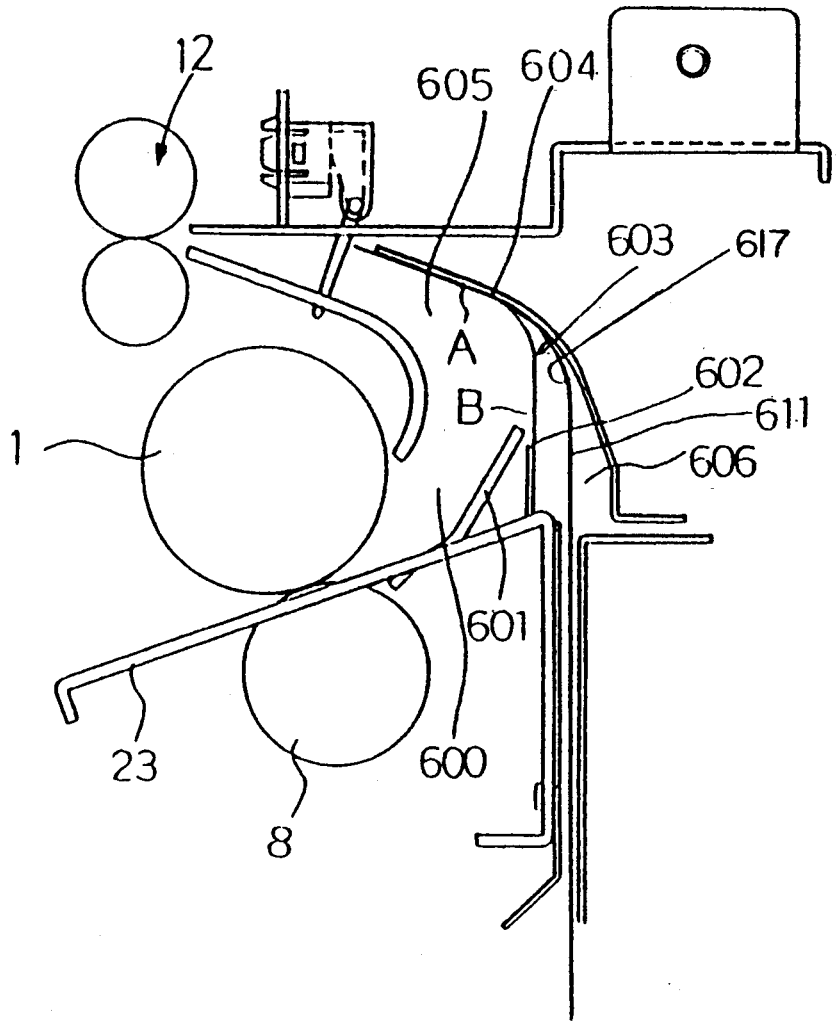
FIG. 15 is a side view showing the embodiment mainly indicating a conveying passage joining part of the sheet feeding mechanism according to the present invention.

When a sheet of another sheet feeding cassette (not shown in FIG. 3) provided below the sheet feeding cassette 5 is selected, the sheet having been fed by a sheet feeding roller 401 in a similar manner to the above is fed to the conveying roller 607 in FIG. 3, by which the sheet is fed to the second conveying passage 606. At this point, as shown in FIG. 15, the leading edge of the sheet 611 having been fed to the second conveying passage 606 hits an inner wall 617 formed on the curved face of the third conveying passage 605, and is bent along the curved face. Then, the sheet is conveyed along into a gap which becomes gradually narrow and is formed between the inner wall 617 and the guide means 603. When the leading edge of the sheet 611 goes near to the head 604 of the guide means 603, the part A including the head 604 of the guide means 603 the part A including manner to be more flexible than the part B is pushed downward by the conveying force of the sheet 611, whereby the sheet 611 passes along the inner wall 617 and smoothly between the inner wall 617 and the head 604 of the guide means 603, and is conveyed toward the pair of conveying rollers 24.

Thus, even where the sheet 611 is fed from the first conveying passage 600, or even where the sheet 611 is fed from the second conveying passage 606, the guide means 603 utilizes the easily deflectable(bendable) properties of the part A and the hardly deflectable properties of the remaining part B (though having resilient properties) to allow the sheet 611 to be fed smoothly to the third conveying passage 605.

Although in the above-described embodiment, the guide means are provided with a plurality of slits to change the deflectable properties thereof, in addition to such method, as shown in FIGS. 17(*a*) through 17(*d*), the following methods may be used: (a) the thickness of part A of the guide means 603 is made thinner than part B; (b) the thickness of the whole guide means 603 is made thin, and part B made double to exhibit the hardly deflectable properties; (c) the thickness of the guide means 603 is made inclined so that the mounting part of the guide means 603 becomes thick and the head 604 thin; or (d) the material of part A of the guide means 603 is made more deflectable than that of part B.

Although in the above-described embodiment, part A of the guide means 603 abuts on the inner wall, part A may be positioned near the inner wall without being in contact with the wall.

As apparent by the above description, the present invention includes guide means in which part A having a specified length from the head is more deflectable than part B, and thus has an advantage that the equipment is simple in structure, inexpensive and can convey sheets smoothly.

With reference to drawings, embodiments of the fifth present invention will be described hereinafter.

Figure 18:
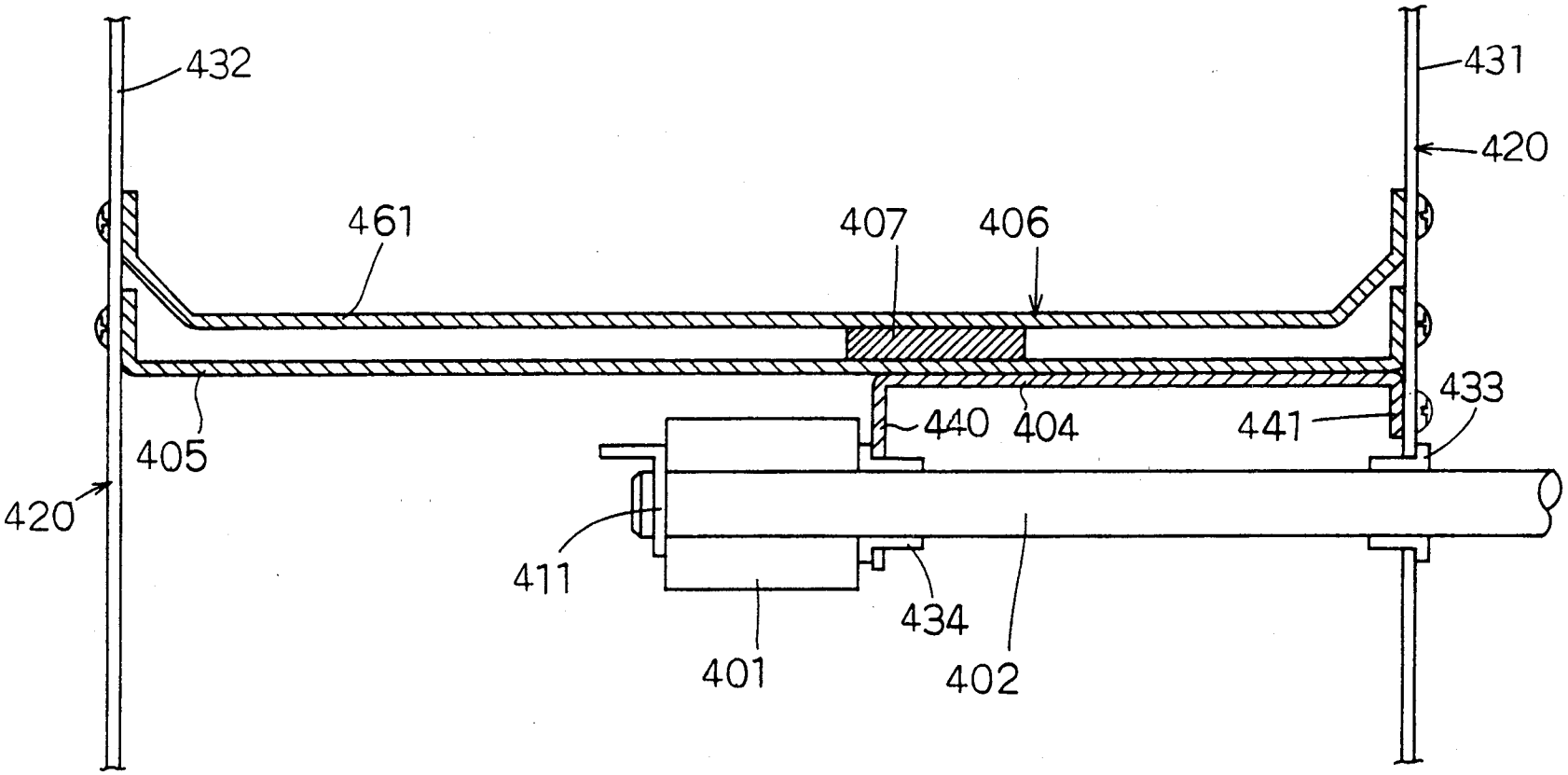
FIG. 18 is a partially sectional view showing the holding mechanism of a sheet feeding roller of a sheet feeding mechanism according to the present invention.

FIG. 18 is a schematic sectional view taken in the direction A of FIG. 3. That is, to a rear frame 431 and a front frame 432 of a body frame 420 are fixed with machine screws both ends of a slender plate-like stay 461 and those of a guide plate 405 being a plate part. Between the central part of the stay 461 and the guide plate 405 therebelow is held an elastic member 407 made of rubber. The stay 461 and the elastic member 407 form a vibration preventive member 406. On the surface of the guide plate 405 opposite to the side on which the elastic member 407 abuts is mounted a supporting member 404 with a machine screw and the like. The supporting member 404 is bent vertically at the both ends thereof and thus has a fixed part 441 and a receiving part 440.

The fixed part 441 of the supporting member 404 is fixed to the rear frame 431 by means of welding and the like, and the receiving part 440 is provided with a bearing 434. By the bearing 434 and a bearing 433 provided to the rear frame 431, a sheet feeding shaft 402 is rotatably supported. The left end of the sheet feeding shaft 402 is extended from the bearing 434 toward the front frame 432, and a sheet feeding roller 401 is installed to the extended end of the sheet feeding shaft 402, which is fixed with a stop ring 411 so that the roller 401 does not slip out. Under the sheet feeding roller 401 is arranged a friction pad roller 430 for preventing the multiple feeding of copying sheets (refer to FIG. 3).

The operation of the above embodiment will be described hereinafter.

When copying operation is started and a copying sheet of the sheet feeding cassette 5 is fed by the sheet feeding roller 401, the copying sheet is conveyed uperstream while being held between the sheet feeding roller 401 and the friction pad roller 430. Where two or more copying sheets are fed, the friction pad roller 430 prevents multiple feeding, whereby only the uppermost copying sheet on the sheet feeding roller 401 side is conveyed.

As described above, the sheet feeding roller 401 is supported only at one side by the bearings 433, 434, so that the sheet feeding mechanism constructed to use the friction pad roller 430 is subjected to a large load when conveying copying sheets, and liable to receive the vibration of upward/downward motion. The vibration of the sheet feeding roller 401 is transmitted from the bearing 434 to the supporting member 404, and then to the guide plate 405 to vibrate. The vibration of the guide plate 405 is transmitted to the elastic member 407 abutting on the guide plate 405, while the elastic member 407 supported by the stay 461 mounted to the body frame 403 absorbs the vibration of guide plate 405 by the resiliency thereof and the supporting force of the stay 461, whereby the guide plate 405 inhibits an abnormal sound occurring due to vibration.

Although in the above-described embodiment, the elastic member 407 uses rubber, in addition to such material, for example, an elastic material of synthetic resin, metal or spring may be used.

Although in the above-described embodiment, the thickness of the elastic member 407 is made equal to the gap formed by the stay 461 and the guide plate 405, the thickness may be made a little larger, for example, 0.2 to 1.0 mm larger than the gap, with the guide plate 405 made a little downward so that vibration further hardly occur. In this case, the shape of the elastic member may be made thick at the central part thereof.

Although in the above-described embodiment, the vibration preventive member 406 is allowed to abut on the plate 405, the member may be allowed to abut on the supporting member to inhibit the vibration.

Although in the above-described embodiment, the vibration preventive member 406 is allowed to abut on the plate 405 from the upper side of the sheet feeding roller 401, the member may be allowed to abut on the part from the lower side of the sheet feeding roller 401. In this case, the member may be allowed to abut on the supporting member 404 instead of the plate 405.

Although in the above-described embodiment, the elastic member 407 of the vibration preventive member 406 is allowed to abut on the plate 405, the elastic member 407 may be formed between the vibration preventive member 406 and the frame mounting part, or by forming the abutting part with a non-elastic material, and by positioning the elastic member held between the abutting part and the vibration preventive member, the vibration can be inhibited.

As apparent by the above description, in the sheet feeding roller holding mechanism provided with a sheet feeding roller for feeding sheets, a sheet feeding shaft to one end of which the sheet feeding roller is detachably mounted, a body frame for holding the other end of the sheet feeding shaft, a supporting member for supporting the sheet feeding shaft by the other end side of the sheet feeding roller, and a plate part mounted to the body frame for supporting the supporting member, the present invention has an advantage that the mechanism is supported by the body frame, and the part thereof abuts on a specified position of the plate part, the supporting member or the sheet feeding shaft in a manner to prevent a deformation they are subject to, thereby inhibiting the vibration of the guide plate in itself to eliminate an abnormal sound.

What is claimed is:

1. A sheet feeding mechanism, comprising:

a sheet feeding cassette including a first sheet advance preventive part projecting outwardly from a side surface of the sheet feeding cassette;

a sheet feeding roller for feeding sheets in a sheet feeding direction;

an advance preventive member which is abuttable on the sheet feeding roller for preventing multiple feeding of sheets, the advance preventive member including a second sheet advance preventive part;

an urging means for providing an urging force to urge the advance preventive member in a direction toward the sheet feeding roller;

whereby when the sheet feeding cassette is moved away from the sheet feeding roller, the first sheet advance preventive part of the sheet feeding cassette acts on the second sheet advance preventive part of the advance preventive member, to thereby separate the advance preventive member from the sheet feeding roller against the urging force of the urging means.

2. A sheet feeding mechanism in accordance with claim 1, wherein:

said first sheet advance preventive part includes a rail provided on the side surface of said sheet feeding cassette, said advance preventive member includes an arm, a pad mounted to one portion of said arm, and a supporting member for supporting said arm, said urging means urges said arm in a manner such that said pad abuts on said sheet feeding roller, said second sheet advance preventive part of said advance preventive member includes a protrusion formed in said arm, and whereby said rail of said first sheet advance preventive part hits on said protrusion of said second sheet advance preventive part when said sheet feeding cassette is moved away from said sheet feeding roller, thereby allowing said protrusion to be moved and said arm to be moved against the urging force of said urging means, to thereby separate said pad from said sheet feeding roller.

3. A sheet feeding mechanism in accordance with claim 1, wherein:

said advance preventive member includes a multiple feeding preventive roller, said preventive roller being rotatable only in a direction reverse to the sheet feeding direction, said second sheet advance preventive part of said advance preventive member includes a first contact part, and said first sheet advance preventive part of said sheet feeding cassette includes a second contact part, wherein when said sheet feeding cassette is moved away from or toward the sheet feeding roller, the second contact part of said first sheet advance preventive part acts on said first contact part of said second sheet advance preventive part, to thereby separate said multiple feeding preventive roller from said sheet feeding roller against the urging force of said urging means.

4. A sheet feeding mechanism in accordance with claim 3, wherein:

said first sheet advance preventive part of said sheet feeding cassette includes a vibration providing part, wherein when said sheet feeding cassette is moved toward or away from said sheet feeding roller, the vibration providing part of said first sheet advance preventive part acts on the first contact part of said second sheet advance preventive part, thereby vibrating said multiple feeding preventive roller of said advance preventive member to rotate said preventive roller.

5. A sheet feeding mechanism in accordance with claim 4, wherein:

said second contact part of said first sheet advance preventive part of said sheet feeding cassette includes said vibration providing part.

6. A sheet feeding mechanism comprising:

a sheet feeding cassette including a first sheet advance preventive part on the sheet feeding cassette;

a sheet feeding roller for feeding sheets;

an advance preventive member which is abuttable on the sheet feeding roller for preventing multiple feeding of sheets, the advance preventive member including a second sheet advance preventive part;

an urging means for providing an urging force to urge the advance preventive member in a direction toward the sheet feeding roller;

a side plate defining an opening connected at an end on a downstream side of a guide plate for guiding sheets, said advance preventive member including a supporting member mounted to an underside of said guide plate, a pad supporting plate connected pivotably under said guide plate to said supporting member, and pad means mounted removably to said pad supporting plate for preventing multiple feeding, whereby when the sheet feeding cassette is moved away from the sheet feeding roller, the first sheet advance preventive part of the sheet feeding cassette acts on the second sheet advance preventive part of the advance preventive member, to thereby separate the advance preventive member from the sheet feeding roller against the urging force of the urging means, wherein said urging means is provided between a first portion of said pad supporting plate and a portion of said side plate lower than said opening of said side plate in order to allow a pad of said pad means to abut on said sheet feeding roller by the urging force of the urging means.

7. A sheet feeding mechanism in accordance with claim 6, wherein:

said pad means includes a pad mounting plate, said pad is fixed to said pad mounting plate, and said pad mounting plate is removably mounted to said pad supporting plate.

8. A sheet feeding mechanism comprising:

a sheet feeding cassette including a first sheet advance preventive part which includes a vibration providing part on the sheet feeding cassette;

a sheet feeding roller for feeding sheets;

an advance preventive member which is abuttable on the sheet feeding roller for preventing multiple feeding of sheets, the advance preventive member including a second sheet advance preventive part, the advance preventive member further including a multiple feeding preventive roller which is rotatable only in a direction reverse to a sheet feeding direction, and said second sheet advance preventive part including a vibration activated part;

an urging means for providing an urging force to urge the advance preventive member in a direction toward the sheet feeding roller;

wherein when said sheet feeding cassette is moved toward and away from the sheet feeding roller, the vibration providing part of said sheet feeding cassette acts on said vibration activated part of said advance preventive member, thereby producing a vibration to said multiple feeding preventive roller of said advance preventive member, to thereby rotate said preventive roller.

9. A sheet feeding mechanism in accordance with claim 8, wherein:

said first sheet advance preventive part includes a guide means provided on said sheet feeding cassette, said advance preventive member includes an arm, said multiple feeding preventive roller mounted to a part of said arm, and a supporting member for supporting said arm, wherein said urging means urges said arm in a manner such that said multiple feeding preventive roller abuts on said sheet feeding roller, said second sheet advance preventive part including a protrusion formed in said arm, and said guide means of said first sheet advance preventive part hits said protrusion of said second sheet advance preventive part when said sheet feeding cassette is moved toward or away from said sheet feeding roller, thereby allowing said protrusion to be moved and vibrated, and said arm to be moved and vibrated against the urging force of said urging means, and thereby vibrating said multiple feeding preventive roller and separating said preventive roller from said sheet feeding roller.

10. A sheet feeding mechanism comprising:

a guide plate for guiding sheets, a side plate which defines an opening and is connected on a downstream side of said guide plate, a supporting member mounted to an underside of said guide plate, a pad supporting plate connected pivotably under said guide plate to said supporting member, pad means removably mounted to a guide plate side of said pad supporting plate for preventing multiple feeding sheets, and urging means provided between a first part of said pad supporting plate and a portion of said side plate lower than said opening of said side plate, to thereby allow a pad of said pad means to abut on said sheet feeding roller by an urging force of said urging means.

11. A sheet feeding mechanism in accordance with claim 10, wherein:

said pad means includes a pad mounting plate, said pad is fixed to said pad mounting plate, and said pad mounting plate is removably mounted to said pad supporting plate.

12. A sheet feeding mechanism, comprising:

a sheet feeding cassette including a first sheet advance preventive part protruding from a bottom surface of the sheet feeding cassette;

a sheet feeding roller for feeding sheets in a sheet feeding direction;

an advance preventive member which is abuttable on the sheet feeding roller for preventing multiple feeding of sheets, the advance preventive member including a second sheet advance preventive part protruding from the advance preventive member;

an urging means for providing an urging force to urge the advance preventive member in a direction toward the sheet feeding roller;

whereby when the sheet feeding cassette is moved away from the sheet feeding roller, the first sheet advance preventive part of the sheet feeding cassette acts on the second sheet advance preventive part of the advance preventive member to thereby separate the advance preventive member from the sheet feeding roller against the urging force of the urging means.

13. A sheet feeding mechanism in accordance with claim 12, wherein:

said advance preventive member includes an arm, a pad mounted to one portion of said arm, and a supporting member for supporting said arm, said urging means urges said arm in a manner such that said pad abuts on said sheet feeding roller, said second sheet advance preventive part of said advance preventive member includes a protrusion formed on an end of said arm away from said portion of said arm including the pad, and whereby said first sheet advance preventive part hits on said protrusion of said second sheet advance preventive part when said sheet feeding cassette is moved away from said sheet feeding roller, thereby allowing said protrusion to be moved and said arm to be moved against the urging force of said urging means, to thereby separate said pad from said sheet feeding roller.

14. A sheet feeding mechanism in accordance with claim 12, wherein:

said advance preventive member includes a multiple feeding preventive roller, said preventive roller being rotatable only in a direction reverse to the sheet feeding direction, said second sheet advance preventive part of said advance preventive member includes a first contact part, said first sheet advance preventive part of said sheet feeding cassette includes a second contact part, wherein when said sheet feeding cassette is moved away from or toward the feeding roller, the second contact part of said first sheet advance preventive part acts on said first contact part of said second sheet advance preventive part, to thereby separate said multiple feeding preventive roller from said sheet feeding roller against the urging force of said urging means.

15. A sheet feeding mechanism in accordance with claim 14, wherein:

said first sheet advance preventive part of said sheet feeding cassette includes a vibration providing part, wherein when said sheet feeding cassette is moved toward or away from said sheet feeding roller, the vibration providing part of said first sheet advance preventive part acts on the first contact part of said second sheet advance preventive part, thereby vibrating said multiple feeding preventive roller of said advance preventive member to rotate said preventive roller.

16. A sheet feeding mechanism in accordance with claim 15, wherein:

said second contact part of said first sheet advance preventive part of said sheet feeding cassette includes said vibration providing part.

17. A sheet feeding mechanism, comprising:

a sheet feeding cassette including a bottom surface onto which a plurality of sheets are placed, and a plurality of side surfaces extending from said bottom surface, said sheet feeding cassette further including a first sheet advance preventive part arranged on one of said side surfaces of the sheet feeding cassette;

a sheet feeding roller for feeding sheets in a sheet feeding direction;

an advance preventive member which is abuttable on the sheet feeding roller for preventing multiple feeding of sheets, the advance preventive member including a second sheet advance preventive part;

an urging means for providing an urging force to urge the advance preventive member in a direction toward the sheet feeding roller;

whereby when the sheet feeding cassette is moved away from the sheet feeding roller, the first sheet advance preventive part of the sheet feeding cassette acts on the second sheet advance preventive part of the advance preventive member, to thereby separate the advance preventive member from the sheet feeding roller against the urging force of the urging means.

* * * * *